US005497791A

United States Patent [19]

Bowen et al.

[11] Patent Number: 5,497,791

[45] Date of Patent: Mar. 12, 1996

[54] SMOKER'S ACCESSORY

[75] Inventors: Larry Bowen, Orangeville; Stanislav M. Snaidr, Mississauga, both of Canada

[73] Assignee: 114935 Ontario Inc., Ontario, Canada

[21] Appl. No.: 226,864

[22] Filed: Apr. 13, 1994

[30] Foreign Application Priority Data

Apr. 14, 1993 [GB] United Kingdom ..... 9307710

[51] Int. Cl.[6] ..... A24F 13/06

[52] U.S. Cl. ..... 131/175; 131/187; 131/201; 131/202

[58] Field of Search ..... 131/329, 330, 131/175, 187, 201, 202, 215.2

[56] References Cited

U.S. PATENT DOCUMENTS

| | | |
|---|---|---|
| 43,906 | 8/1864 | Foley . |
| 258,255 | 5/1982 | Schleber . |
| 973,890 | 10/1910 | Surbrug . |
| 1,619,408 | 3/1927 | Ferguson . |
| 1,821,267 | 9/1931 | Loesch . |
| 1,858,938 | 5/1932 | Raftey . |
| 1,897,976 | 11/1937 | Birkholz . |
| 2,159,121 | 5/1939 | Alley . |
| 2,323,856 | 7/1943 | Tillman . |
| 2,663,300 | 12/1953 | Pinto . |
| 2,802,405 | 6/1957 | Krogel . |
| 2,966,157 | 8/1957 | Touey . |

(List continued on next page.)

FOREIGN PATENT DOCUMENTS

| | | |
|---|---|---|
| 803257 | 1/1969 | Canada . |
| 807960 | 3/1969 | Canada . |
| 821263 | 8/1969 | Canada . |
| 826919 | 11/1969 | Canada . |
| 942611 | 2/1974 | Canada . |
| 943425 | 3/1974 | Canada . |
| 955141 | 9/1974 | Canada . |
| 959733 | 12/1974 | Canada . |
| 1024457 | 1/1978 | Canada . |
| 1044552 | 12/1978 | Canada . |
| 1057924 | 7/1979 | Canada . |
| 1063946 | 10/1979 | Canada . |
| 1085319 | 9/1980 | Canada . |
| 1093414 | 1/1981 | Canada . |
| 1100746 | 5/1981 | Canada . |
| 1103175 | 6/1981 | Canada . |
| 1158515 | 12/1983 | Canada . |
| 1196833 | 11/1985 | Canada . |
| 1268718 | 5/1990 | Canada . |
| 1278659 | 1/1991 | Canada . |
| 1311889 | 12/1992 | Canada . |
| 4091778 | of 0000 | Japan . |
| 5-103652 | 4/1993 | Japan . |
| WO90/07941 | 9/1990 | WIPO . |
| WO90/09741 | 9/1990 | WIPO . |
| WO95/02970 | 2/1995 | WIPO . |

*Primary Examiner*—Jennifer Bahr
*Attorney, Agent, or Firm*—Banner & Allegretti, Ltd.

[57] ABSTRACT

A smoker's accessory for filtering sidestream smoke emitted from a burning cigarette comprises an exhaust fan mounted in a central unit and a sidestream smoke filter cartridge having a cigarette tube for a burning cigarette, is placed is provided alongside the central component. The filter cartridge is provided in a housing which is connected to the central fan support. The cigarette tube is as long as a cigarette and has a diameter of at least 1.5 times the diameter of the cigarette. A porous low pressure drop filter element is provided at the end of the cigarette tube for removing sidestream smoke. The housing has a front end wall in which the cigarette holder with the cigarette to be positioned. A fresh air inlet is provided which permits the fan to draw fresh air inside the cigarette tube along the cigarette and pick up the sidestream smoke from the lit cigarette for purposes of drawing through the filter cartridge before release to the surroundings. The smoker's accessory may optionally be provided with an exhale filter so that both sidestream smoke and exhale smoke is filtered before release to the surroundings. The filters are high efficient, low pressure drop filters which ensure there is minimal, if any, detectable traces of cigarette smoke released to the surroundings.

52 Claims, 16 Drawing Sheets

U.S. PATENT DOCUMENTS 2,986,146 5/1961 Li .
3,079,929 3/1963 Mueller .
3,225,390 10/1966 Kistler .
3,318,317 5/1967 Sproull .
3,327,718 6/1967 Kilburn .
3,362,415 1/1968 Ellis .
3,368,566 2/1968 Avedikian .
3,393,120 7/1968 Touey .
3,621,851 11/1971 Heskett .
3,685,523 8/1972 Labbe .
3,685,527 8/1972 Sherrill .
3,827,444 8/1974 Khan .
3,854,384 12/1974 Naylor .
3,882,877 5/1975 Brackmann et al. .
4,007,745 2/1977 Randall .
4,052,179 10/1977 Kirk .
4,062,368 12/1977 Crellin .
4,069,297 11/1978 Saito .
4,164,230 8/1979 Pearlman .
4,198,992 4/1980 Smith .
4,200,114 4/1980 Waite .
4,274,428 6/1981 Muller .
4,285,831 8/1981 Yoshida .
4,289,149 9/1981 Kyriakou .
4,362,169 12/1982 Calkins .
4,369,798 1/1983 Jackson .
4,370,988 2/1983 Terasaki .
4,570,646 2/1986 Herron .
4,602,646 7/1986 Cascalenda .
4,630,620 12/1986 Gabriel .
4,637,407 1/1987 Bonanno et al. .
4,685,477 8/1987 Valdez .
4,773,435 9/1988 Ikeda .
4,784,892 11/1988 Storey .
4,788,988 12/1988 Titus .
4,790,332 12/1988 Wallace .
4,807,646 2/1989 Sahar .
4,809,717 3/1989 Imbery .
4,858,627 8/1989 Netschert .
4,899,766 2/1990 Ross .
4,901,739 2/1990 Benavente .
4,904,343 2/1990 Giglia .
4,922,931 5/1990 Nare .
4,993,435 2/1991 McCann .
5,048,545 9/1991 Takagi .
5,088,508 2/1992 Duncan .
5,131,416 7/1992 Gentry .
5,154,192 10/1992 Sprinkel .
5,160,518 11/1992 Vega, Jr. .
5,169,528 12/1992 Karbachsch .
5,190,061 3/1993 Brackmann .
5,220,930 6/1993 Gentry .
5,265,626 11/1993 Schneider .
5,279,731 1/1994 Cook .
5,363,814 10/1994 Martin .

FIG.3.
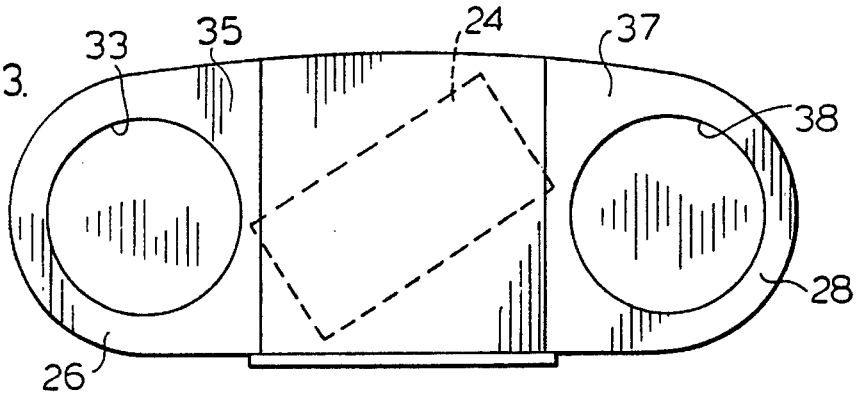
FIG.4.
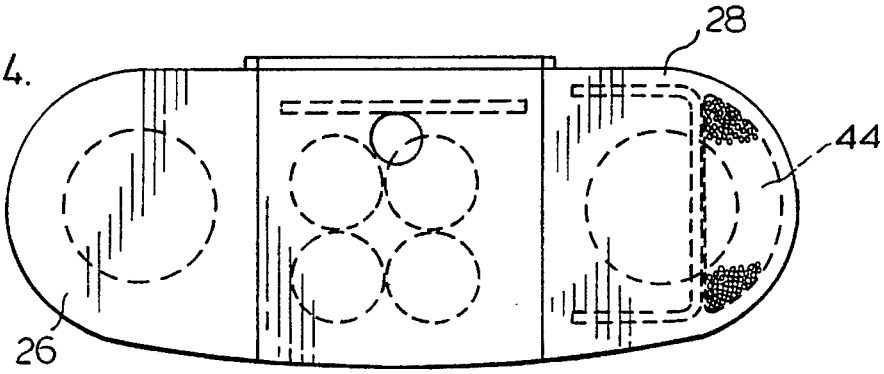
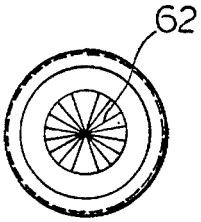
FIG.5c.
FIG.5a.
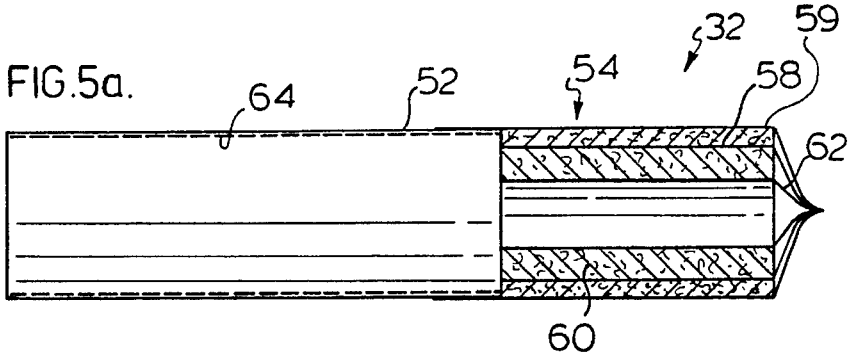
FIG.5b.
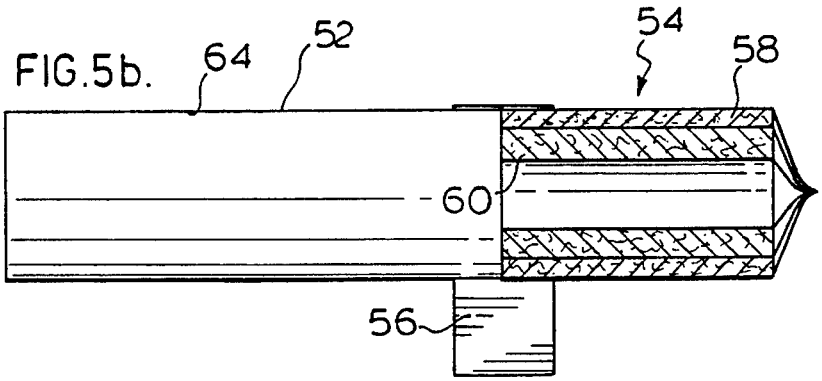

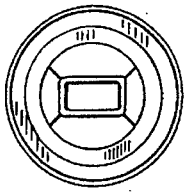
FIG.6b.
FIG. 6a.
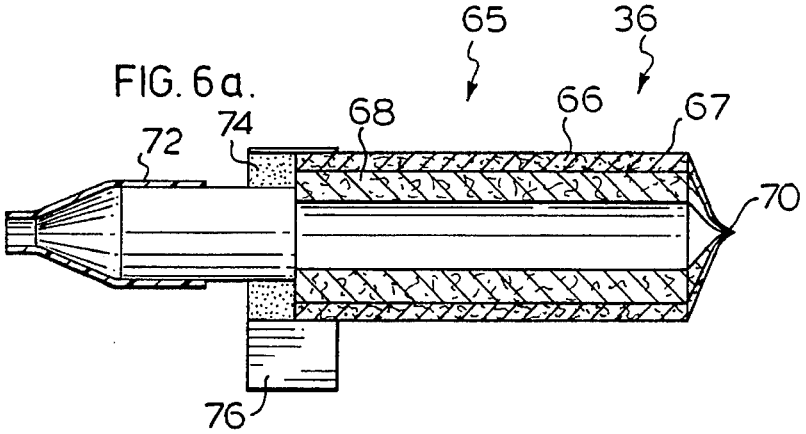
FIG.7.
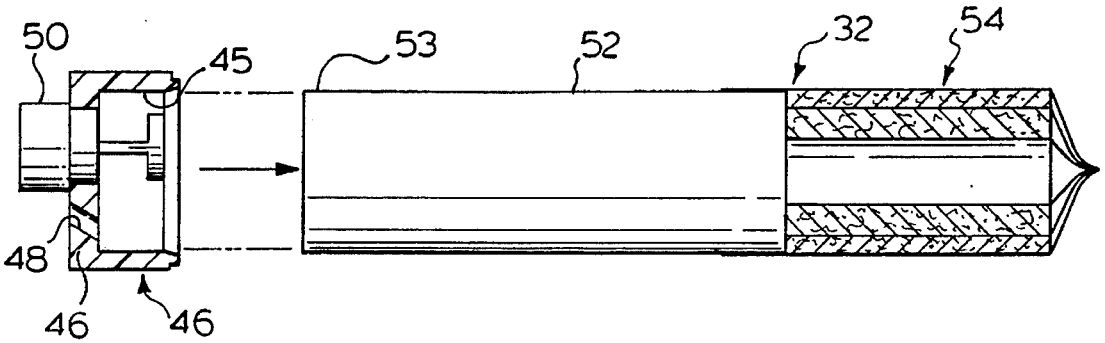

252
86
186
184
188
175
182
198
250
198
88
172
173
178
174
138
176
180
178
148
132
168
170

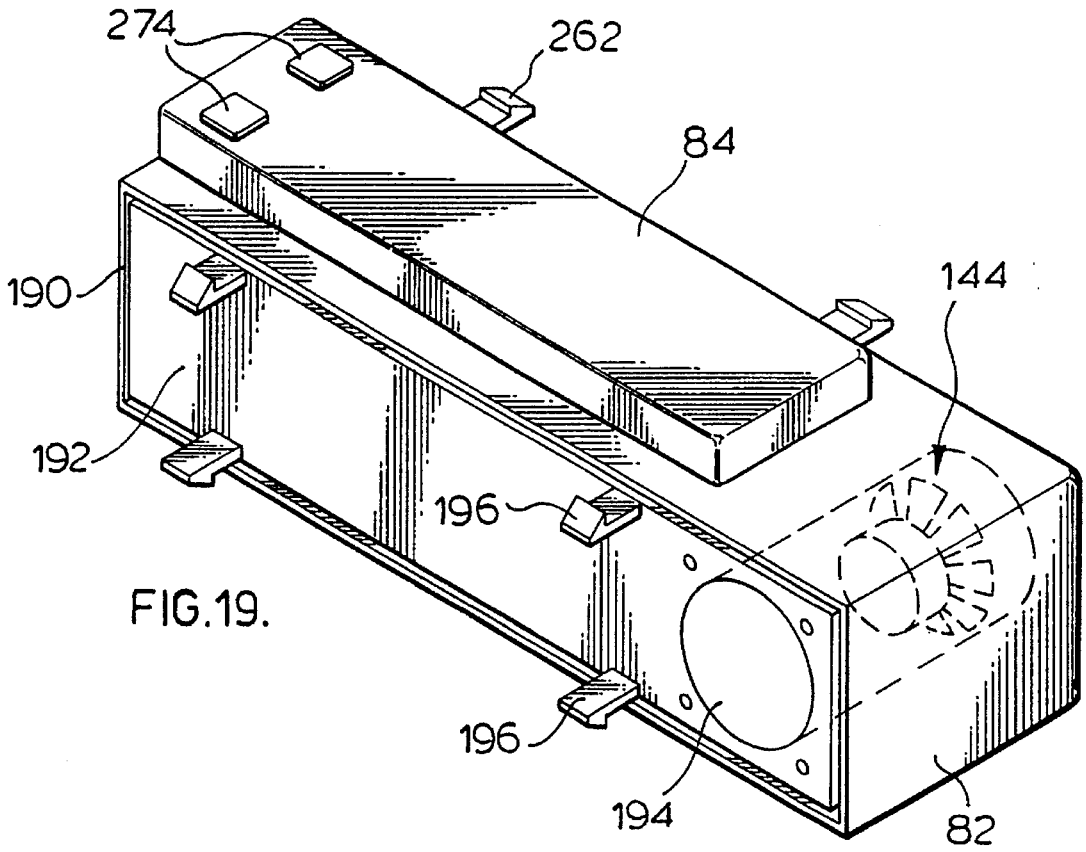
FIG.19.
FIG. 20.
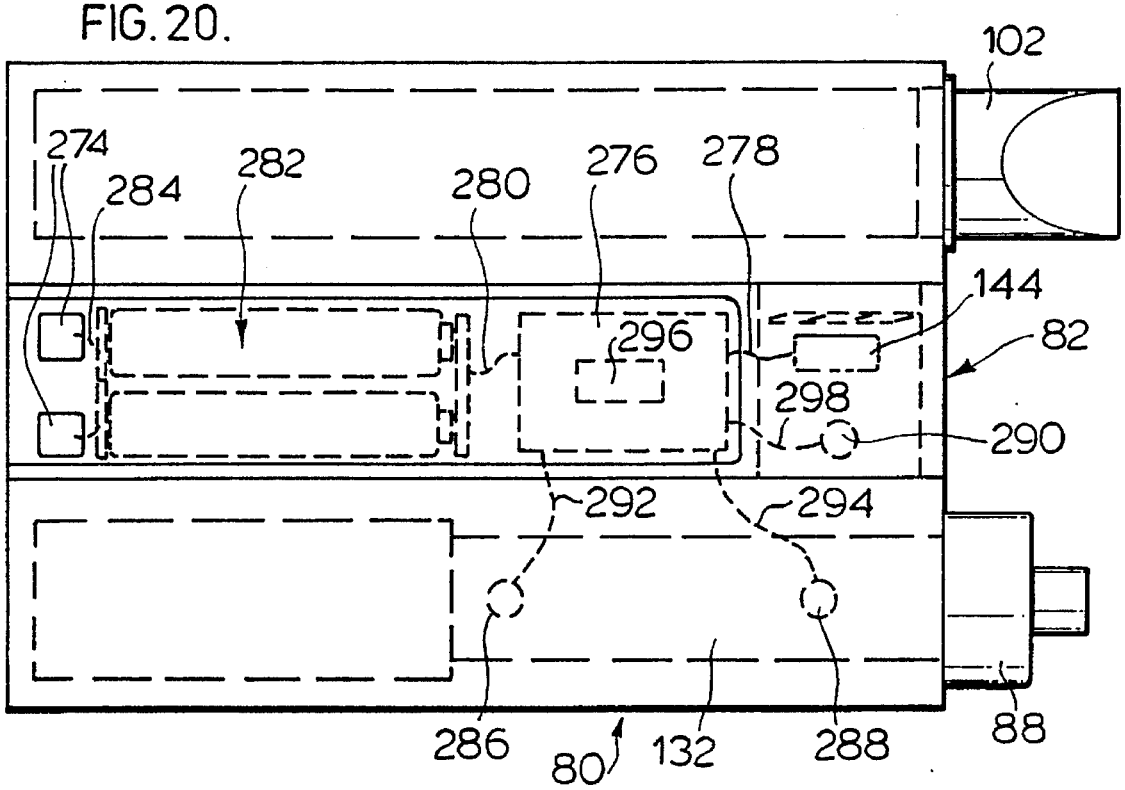

SMOKER' S ACCESSORY

FIELD OF THE INVENTION

This invention relates a smoker's accessory for filtering sidestream smoke emitted from a burning cigarette and optionally may also be equipped to filter exhale smoke.

BACKGROUND OF THE INVENTION

When a cigarette is smoked, visible smoke is produced, by mainstream smoke spillage, exhale smoke and as well sidestream smoke which is generated by the burning cigarette between puffs. This smoke is considered objectionable by some persons and this has led to no-smoking laws of varying degrees of strictness in certain jurisdictions and environments.

A number of prior proposals have been made with respect to structures which are designed to minimize or eliminate the formation of visible cigarette smoke. Such prior proposals have tackled the major source of cigarette smoke; namely that derived from sidestream smoke and exhale smoke. It is appreciated that the mainstream smoke spillage is a very minor portion of visible smoke. However, no device disclosed in the prior art known to the applicants provides for the elimination of substantially all the visible sidestream and exhale smoke and also provides the same smoking taste and quality to the smoker as if smoked in the normal way.

One prior structure is disclosed in U.S. Pat. No. 4,790,332. This patent describes a hand-held enclosure in which is positioned the lighted cigarette. Smoking is effected through a holder formed in one end wall of the device and in which the filter-end of the cigarette is mounted. Exhalation of smoke is effected through a one-way valved passageway formed in the same end wall of the device as the holder, permitting exhale smoke to pass into the enclosure. The opposite end wall as well as the side walls of the enclosure have a tobacco smoke filter provided therein, to filter the particulate and odoriferous elements from the smoke leaving the enclosure. This arrangement, while substantially eliminating visible smoke and the characteristic smell of tobacco smoke, suffers from the drawback that the smoke present in the enclosure, as a result of static burning or exhale, causes an off-flavour to be introduced to the tobacco smoke drawn by the smoker through the cigarette into his mouth.

U.S. Pat. No. 4,198,992 describes a device in which the cigarette again is enclosed for smoking. No provision is made in this instance for the disposal of exhale smoke. The device employs air pressure in the enclosure to force sidestream smoke through the cigarette.

U.S. Pat. No. 4,200,114 describes a device in which the cigarette again is enclosed for smoking. The device provides for disposal of both sidestream smoke and exhale smoke. The device in use is permanently mounted to the face of a smoker, with a mask enveloping the smoker's mouth and nose. A complicated series of check valves permits air to be drawn for breathing and to be exhaled into a combustion chamber in which the lit cigarette is positioned, and from which air and smoke passes through a filter to atmosphere, and permits cigarette smoke to be drawn from the cigarette.

U.S. Pat. No. 4,899,766 describes a device for disposal of sidestream smoke and exhale smoke. A fan is used in conjunction with filters to draw sidestream smoke and, while exhaled through a hand activated valve, exhale smoke, into a pipe for further passage through the filters.

U.S. Pat. No. 5,048,545 describes a system in which sidestream smoke and exhale smoke are collected in a container which only later is vented. There is no treatment of the smoke contemplated only the collection thereof.

U.S. Pat. No. 4,637,407 describes an enclosure for a burning cigarette intended to protect against fires started by the burning tip of the cigarette. A forced flow of air, by way of a small fan, is provided to maintain the cigarette lit and sidestream smoke removal is effected by a filter downstream of the fan. No provision is made in this structure for the disposal of exhale smoke.

U.S. Pat. 4,993,435 discloses a smoker's accessory which captures sidestream smoke for inhalation by the user and is provided with an exhale filter arrangement. Several serially arranged filter discs are provided.

U.S. Pat. No. 5,160,518 discloses a smoker's accessory which comprises a U-shaped tube. The lit cigarette is placed in one leg of the U-shaped tube and the exhale filter is placed in the other leg of the U-shaped tube. A fan is mounted in front of the lit cigarette to direct fresh air at the end of the cigarette and through the exhale filter. Several one-way valves are employed to direct either sidestream smoke or exhale smoke through the single filter before release to the surroundings. The filter is made of activated carbon, which although useful in removing gaseous components in cigarette smoke is not that effective for removing particles from the cigarette smoke. As a result the filtered smoke when released to the surroundings is still detectable and hence not acceptable. Furthermore, the cigarette is encased in a small diameter metal tube which carries with it the problems identified with respect to the other devices where the cigarette is not burned in a normal manner so that the taste and flavour of the inhaled smoke is greatly affected.

Another form of hand-held cigarette smoke filter is disclosed in Japanese published patent application HEI3-177280 published Apr. 27, 1993. The application discloses a device in which a cigarette is placed. A mouth piece is provided to permit inhalation of the cigarette smoke. Any sidestream smoke is filtered by surrounding filters. However, when the cigarette is inhaled the stale sidestream smoke is also inhaled thereby greatly affecting flavour and taste. A one-way valve is employed to ensure that smoke exhaled into the unit is directed through a filter before release to the surroundings. A small metal tube surrounds the lit cigarette which greatly affects the flavour and taste of the inhaled smoke.

Considerable efforts have been made in the area of filters as provided on cigarettes to effect a partial filtration to reduce the amount of tar and nicotine inhaled by the user. It is appreciated that cigarette filters however are not designed to remove substantially all of the cigarette smoke so that the smoker continues to experience the usual sensations. There have been however cigarette filters which are tubular in nature and designed to filter some of the smoke particles from the smoke stream. U.S. Pat. No. 3,685,523 discloses a tubular cigarette tip filter which partially filters the cigarette smoke as it passes from the interior of the tubular filter to the exterior thereof for inhale by the smoker. A similar type of filter is described in U.S. Pat. No. 3,854,384 involving a tubular filter only offset with respect to the central axis of the cigarette. Both filters are however of marginal performance so as to not remove the various components of cigarette smoke which give the user the desired taste and flavour.

Canadian Patent 1,057,924 as issued to the applicant describes a method of producing polymeric fibres of micron size which can be used in cigarette filters. Such micro-fibre has been used in cigarette filters of the type described in applicant's U.S. Pat. No. 3,882,877 and International patent application WO90/09741. The micro-fibres produced by the method of Canadian Patent 1,057,924 have increased filtration efficiency compared to cigarette filters of the standard cellulose acetate, charcoal and the like. In order to take advantage of the efficiency of those filters a thin cylindrical filter is provided in the filter tip of a cigarette as described in WO90/09741 which provides for uniform tar delivery while smoking the cigarette.

SUMMARY OF THE INVENTION

In accordance with an aspect of the invention, a smoker's accessory for filtering sidestream smoke emitted from a burning cigarette, comprises:

an exhaust fan, means for supporting the exhaust fan, the support means having a sidewall with an inlet for the fan, a sidestream smoke filter cartridge having a cigarette tube in which a burning cigarette is placed, the cigarette tube being at least as long as a cigarette to be smoked and having a diameter at least about 1.5 times the diameter of a cigarette, the cigarette tube being non-porous to sidestream cigarette smoke particles, a porous low pressure drop tubular filter element at an end of the cigarette tube for removing sidestream smoke, the filter element having an inlet end for sidestream cigarette smoke to enter an inner elongate chamber within the tubular filter, the tubular filter having a closed end opposite the inlet end, means for connecting a first end of the cigarette tube to the inlet end of the filter element whereby sidestream smoke to be filtered flows along the cigarette tube, into the inner chamber, and outwardly through the tubular filter element, a housing for the sidestream smoke filter cartridge, the housing having a front end wall with an opening provided therein, a cigarette holder having a bore into which a lit cigarette may be inserted, such cigarette being supported in the cigarette tube by the holder, means for mounting the cigarette holder in the housing opening, means for securing a second end of the cigarette tube to the cigarette holder whereby a lit cigarette in the holder is positioned in the cigarette tube, fresh air inlet means for providing fresh air inside the cigarette tube adjacent the second end of the cigarette tube, the exhaust fan drawing fresh air from the fresh air inlet along the cigarette tube and over a lit cigarette, sidestream smoke from a lit cigarette being drawn through the filter cartridge, such filtered air stream being drawn through the housing outlet and into the fan inlet for exhaust by the fan.

In accordance with another aspect of the invention, a smoker's accessory for filtering sidestream smoke emitted from a burning cigarette and for separately filtering exhale cigarette smoke comprises:

an exhaust fan, means for supporting the exhaust fan, the support means having a sidewall with an inlet for the fan, a sidestream smoke filter cartridge having a cigarette tube in which a burning cigarette is placed, the cigarette tube being at least as long as a cigarette to be smoked and having a diameter at least about 1.5 times the diameter of a cigarette, the cigarette tube being non-porous to sidestream cigarette smoke, a porous low pressure drop tubular filter element at an end of the cigarette tube for removing sidestream smoke, the filter element having an inlet end for sidestream cigarette smoke to enter an inner elongate chamber within the tubular filter, the tubular filter having a closed end opposite the inlet end, a first housing for the sidestream smoke filter cartridge, the housing having a front end wall with an opening provided therein, a cigarette holder having a bore into which a lit cigarette may be inserted, such cigarette being supported in the cigarette tube by the holder, means for mounting the cigarette holder in the housing opening, means for securing a second end of the cigarette tube to the cigarette holder whereby a lit cigarette in the holder is positioned in the cigarette tube, fresh air inlet means for providing fresh air inside the cigarette tube adjacent the second end of the cigarette tube, an exhale smoke filter cartridge having an inner tubular member consisting of micro-fibres for removing particulate material from cigarette smoke, the tubular filter having an inlet end for cigarette smoke to enter an inner elongate chamber within the tubular filter, the tubular filter having a closed end opposite the inlet end, the micro-fibres having an average diameter in the range of about 0.5 to about 10 microns, and being made from a suitable micro-fibre forming composition, an outer filter shell surrounding the inner filter, the outer filter shell consisting of activated carbon material held by a support matrix which is porous to air flow, the inner tubular filter being of sufficient thickness to remove substantially all particulate components from cigarette smoke passing from the inner elongate chamber through the tubular filter, the micro-fibre filter material having a low pressure drop to permit an air stream to flow through the filter with minimal resistance to such flow, the activated carbon outer filter shell being of sufficient thickness for adsorbing substantially all gaseous components of cigarette smoke from such filtered exhaled cigarette smoke stream, an exhale mouthpiece in which a first end portion adjacent the inlet end of the exhale filter cartridge is fitted to facilitate a user exhaling into the exhale filter cartridge, a second housing for the exhale filter cartridge, the second housing having an outlet to permit exhale through the exhale filter cartridge, the second housing having a front end wall in which an opening is provided, means for mounting the exhale mouthpiece in the second housing opening to support the exhale filter cartridge in the second housing, the exhaust fan drawing fresh air from the fresh air inlet along the cigarette tube and over a lit cigarette, sidestream smoke from a lit cigarette being drawn through the filter cartridge, such filtered air stream being drawn through the housing outlet and into the fan inlet for exhaust by the fan.

BRIEF DESCRIPTION OF THE DRAWINGS

Preferred embodiments of the invention are described with respect to the drawings wherein:

FIG. 3 is a front elevational view of the smoking apparatus shown in FIG. 1;

FIG. 4 is a rear elevational view of the smoking apparatus of FIG. 1;

FIGS. 5A, 5B and 5C contain sectional and end views of a sidestream filter cartridge for use with the smoking apparatus of FIG. 1;

FIGS. 6A and 6B contain sectional and end views of an exhale filter cartridge for use with the smoking apparatus of FIG. 1;

FIG. 7 shows an exploded view of an assembly of the sidestream filter cartridge of FIG. 5 and a mounting element;

FIGS. 8A through 80, show a series of sectional and end elevational views of cartridge mounting elements and cigarette holders of a variety of constructions;

FIG. 19 is a perspective of the central body portion of the smoker's accessory;

FIG. 20 is a schematic showing components of electronic process control of the smoker's accessory;

DEFINITIONS

Figure 2:
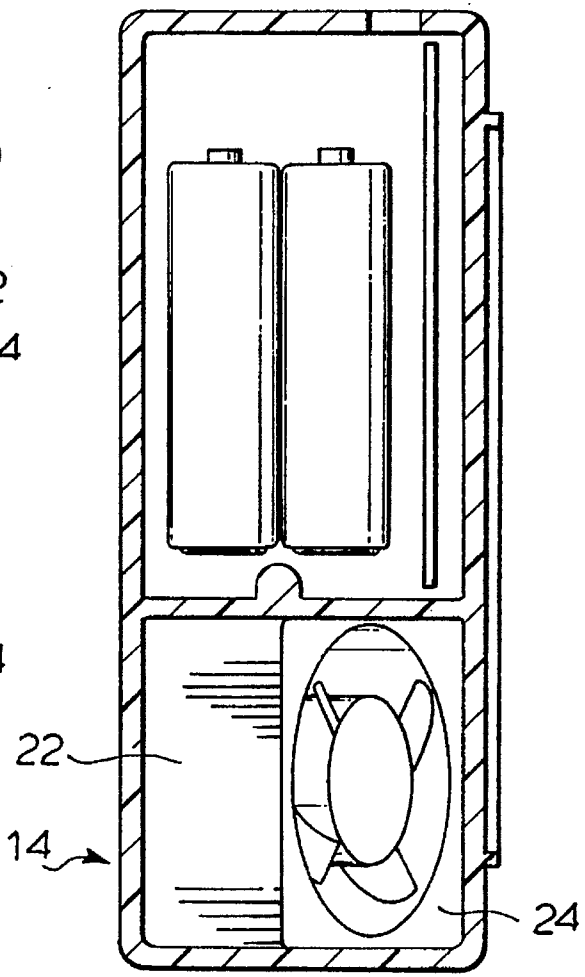
FIG. 2 is a side elevational sectional view of the smoking apparatus shown in FIG. 1.
Figure 1:
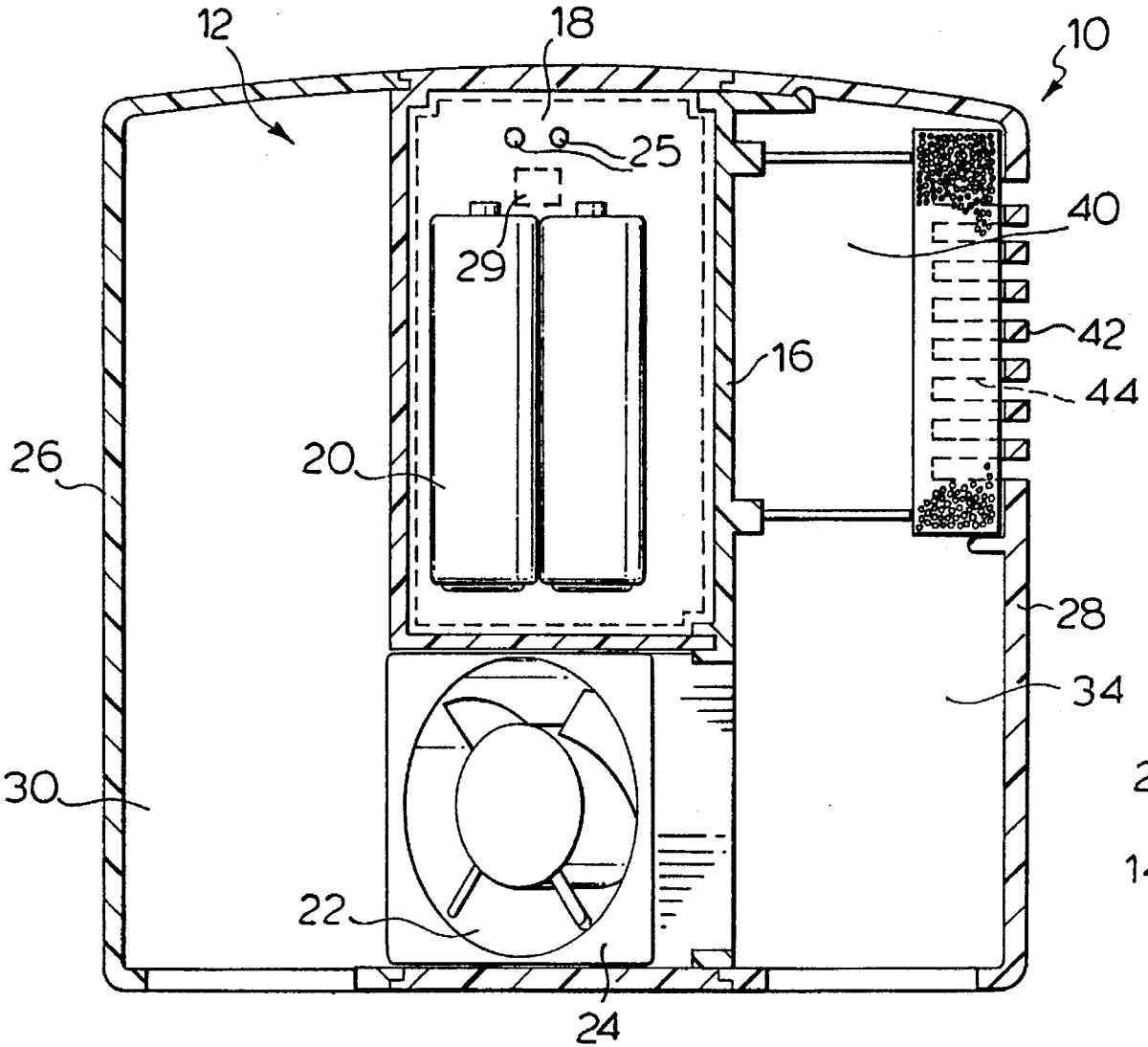
FIG. 1 is a plan sectional view of a smoking apparatus provided in accordance with one embodiment of the invention.

In order to facilitate discussion of the various embodiments of the invention, the following definitions are provided of various aspects of those embodiments:

Exhale Smoke means cigarette smoke exhaled by a smoker while smoking a cigarette.

Gaseous Components means the components of cigarette smoke other than particulate components and which, if present in an air stream, provides a detectable smell of cigarette smoke.

Low Pressure Drop means that the material is sufficiently porous to air flow that a pressure drop across the material is sufficiently low that the size of the fan, the power therefor, the exhale pressure are of a nature that the smoker's accessory may be hand held. In order to optimize the accuracy design, a low pressure drop is preferably less than about 10 mm $H_2O$.

Micro-fibres means fibres having an average diameter of about 10 microns or less.

Minimal resistance to air flow means that the filter material or the like provides a very low pressure drop to air passing therethrough.

Non-Porous means that the material does not permit flow of the designated components through the material. For example, if a material is nonporous to smoke particles then smoke particles are prevented from travelling through the material but for example, air could continue to travel through the material.

Particulate Components means the visible and non-visible components of cigarette smoke which exist in particle form and are usually of a size less than 1 micron and normally of a size in the range of about 0.1 and about 0.6 microns.

Porous means that the material is sufficiently open with holes, channels or the like to permit air to flow therethrough.

Sidestream Smoke means cigarette smoke which rises from a lit cigarette.

Substantially All means in respect of removal of particulate components or gaseous components from cigarette smoke that there are substantially no visual or gaseous components remaining which can at least be detected by smell.

Suitable Micro-Fibre Forming Composition includes any material which can be formed into micro-fibres and when contacted by cigarette smoke, retains its structure and functional characteristics.

Tube or Tubular means a elongate hollow article which has a sidewall of any desired cross-sectional shape, such as, circular, rectangular, square, triangular, oval, multisides (5 sides or greater) and the like.

DETAILED DESCRIPTION OF THE PREFERRED EMBODIMENTS

Referring to the drawings, there is illustrated a smoker's accessory 10, in accordance with one embodiment of the invention. The smoker's accessory comprises a multi-chamber enclosure 12 in which substantially all smoke from a cigarette, both drawn from the cigarette by the smoker and sidestream smoke, is eliminated before discharge of air to atmosphere.

Figure 10:
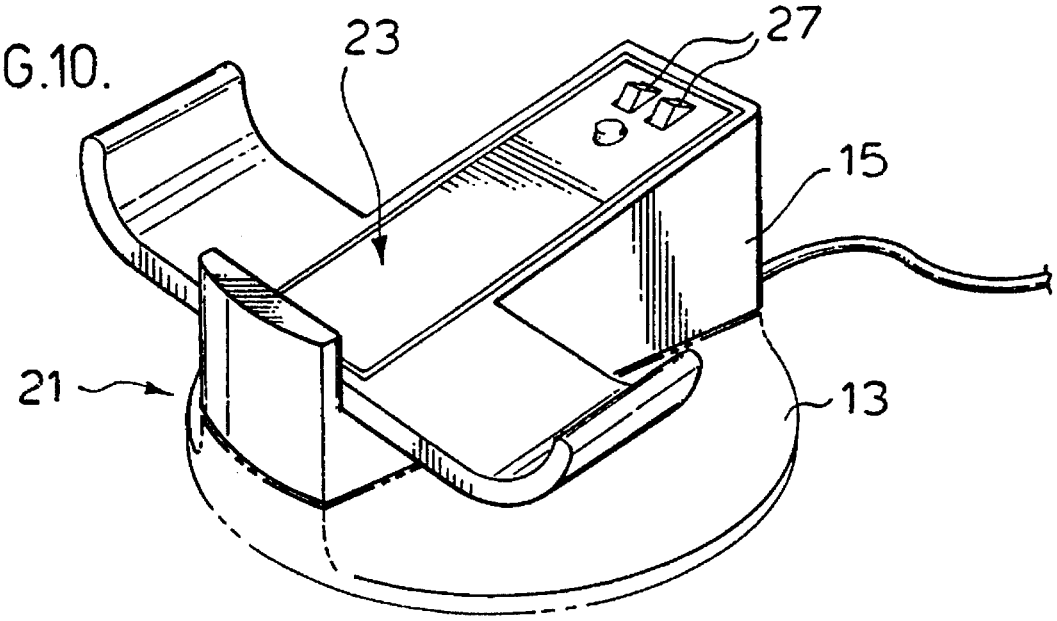
FIG. 10 is a perspective view of a stand for use with the device of FIG. 1 and which also charges the unit.

The enclosure 12 is formed of interlocking and assembled parts, which may be molded elements to facilitate assembly. The assembly includes a central part 14 which is assembled with an intermediate cover element 16. The assembled central part 14 and cover element 16 define a cavity 18 housing a battery or batteries 20 to power electronic elements of the smoking apparatus. The batteries 20 may be of a disposable type or of a rechargeable type to avoid having to disassemble the structure for battery replacement. Electrical charging terminals 25 may be provided in the lower wall of the smoking apparatus 10 to permit charging of the batteries 20 by a suitable charging device. Such charging device may take the form of a stand, as seen, for example, in FIG. 10. The charging device 21 has a cradle 23 to receive and hold the smoker's accessory 10. The accessory external terminals 25 contact the charging terminals 27 of charging device 21 when the accessory is resting in the cradle 23. The cradle 23 is supported on the base 13 by a standard 15. The standard 15 may be short as shown in FIG. 10 or may be long to elevate the cradle 23. Elevation of the cradle is useful in circumstances when "hands-free" operation of the smoker's accessory is desired. The standard may position the accessory at mouth level when the base is on a desk. The base and standard are sufficiently stable to ensure that the smoker may use the unit 10 in a "hands free" mode.

On the lower face of the smoking apparatus 10, there may be provided an on-off switch as shown in dot at 29, to activate and deactivate the fan 24 and other electrical elements of the device and LED lights may be provided to indicate visually conditions of the smoking apparatus 10.

The assembled central part 14 also defines a further cavity 22 in which is positioned a fan 24 for drawing air through the enclosure 12, as described in more detail below.

The left- and right-hand side assemblies 26, 28 comprising inhale and exhale sections respectively, are mounted to the central elongate cuboid assembly of central part 14 and cover element 16 by interengaging snap-fit mounting elements provided on the respective elements of the assembly to provide the enclosure 12. The enclosure 12 so provided is elongate with an approximately ellipsoid cross section (see FIGS. 3 and 4) and is of a convenient size and shape to permit comfortable use of the device 10 by the smoker.

The side assembly 26 defines with the central part 14 an enclosure chamber 30, into which is received a sidestream filter cartridge 32 (FIGS. 5 and 7) through an opening 33 at the front end 35 thereof. The side assembly 28 defines with the central part 14 a further enclosure chamber 34, into which is received an exhale filter cartridge 36 (FIG. 6) through an opening 38 at the front end 37 thereof. The fan 24 is positioned to draw air and other gases from the enclosure 30 to the enclosure chamber 34. The enclosure 34 commences with a discharge enclosure chamber 40, which is provided with a series of slots 42 in the side wall thereof for discharge of gases from the entire enclosure 12. A further filter element 44, such as a carbon filter, is provided as a final clean up of odour causing gaseous components prior to discharge of filtered air from the enclosure 12. Separate or in conjunction with filter 44, an additional component may be provided at the outlet slots to freshen the air with a suitable fragrance. The fragrance may be emitted by a suitable replaceable sponge or the like containing the vaporizable fragrance.

The sidestream smoke filter cartridge 32 extends longitudinally in the enclosure chamber 30 and has a mounting element 46 which includes a cigarette holder. The cartridge 32 is mounted in the mounting element 46 and which itself mounts in the opening 33. The mounting element 46 has a series of bores 48 passing therethrough, permitting the passage of air into the interior of the sidestream smoke filter cartridge 32. A cigarette holder 50 is mounted in the mounting element 46 to hold a cigarette within the sidestream smoke filter cartridge 32 and the filter end of the cigarette projects outside of the holder 50. The cigarette is preferably smoked in a normal manner through its filter tip portion. It is understood that the cigarette including its filter tip may be housed in the cigarette tube. A suitable cigarette holder with mouthpiece can be provided in the mounting element 46. The user then inhales a lit cigarette through the mouthpiece.

A variety of filter units are available for use in the smoker's accessory to filter sidestream and/or exhale smoke. Filter blocks could be positioned in the enclosure chamber 30, 34 and 40 where the sidestream and exhale smoke are channelled through the filter blocks. However, such systems usually involve plastic components to direct a flow of smoke onto the filter blocks. Although those systems are useful, the plastic components for channelling the smoke to the filter blocks become contaminated and require cleaning from time to time. In accordance with a preferred aspect of this invention, it is preferred that both the sidestream filter and the exhale filter effect filtering action on the smoke almost immediately as it is released from the cigarette in the case of sidestream smoke or from the user in the case of exhale smoke. It is therefore preferred to use the tubular type of filter cartridges as shown in FIGS. 5, 6, 27 and 29 to achieve filtration of the sidestream and exhale smoke. The preferred tubular filters are described in detail in applicants co-pending United States patent application Ser. No. 08/226,890 filed Apr. 14, 1994, the subject mater of which is hereby incorporated by reference thereto. To facilitate discussion of various aspects of the smoker's accessory, the following brief description of the filters is provided.

The sidestream smoke filter cartridge 32 of FIGS. 5A and 5B comprises a tube 52 of cardboard or similar inexpensive material, within which is located a cigarette for smoking and a closed-end tubular assembly 54 of cigarette smoke filter material attached to the cardboard tube 52 in any convenient manner, such as by cigarette tipping paper 56.

The filter material comprising the filter element 54 preferably includes a highly-efficient low pressure drop smoke filter material 58 which removes substantially all particulate material from sidestream smoke of a burning cigarette located in the filter cartridge 32, so that only substantially invisible gaseous components of the cigarette smoke pass therethrough.

The highly-efficient low pressure drop tobacco smoke filter material 58 preferably comprises micro-fibre material. Such fibrous material generally has a uniform diameter along its length ranging from about 0.5 to about 10 microns. The desired pressure drop for the material may be determined and measured in a variety of well known techniques such as displacement of measured mm of $H_2O$ in a pressure sensing device. Preferably, the filter material has a low pressure drop in the range of about 5 to about 10 mm of $H_2O$. An alternate measure of pressure drop is Corseta units. The filters of this invention should have a Corseta rating in the range of about 10,000 Corseta units.

The micro-fibre filter material in the filter element 58 may have a thickness of about 0.3 to about 6 mm and a packing weight of about 5 g/m$^2$ to about 500 g/m$^2$ for sheet thickness in the range of about 0.1 mm to about 3 min. The filter material 58 may be used without any support or may be supported in any convenient manner in the filter element 54, such as by an inner layer of coarse filter material 60, which effects an initial filtration of the sidestream smoke before the micro-fibre fibres are encountered. The outer surface of the micro-fibre filter element 58 may be supported by a suitable porous mesh material 59 which may be crimped or bunched up in a manner to form a seal at 62, as shown in FIG. 5A.

The cardboard tube 52 preferably is provided with a lining 64 of charcoal or the like to minimize the possibility of burning the cardboard tube and also to adsorb condensates from the cigarette smoke and hence assist in the elimination of odour.

The disposable sidestream smoke filter cartridge 32 is intended to be employed for the smoking of one or more cigarettes and then to be discarded. The tubular nature of the assembly ensures that sidestream smoke is filtered before encountering any other part of the apparatus so that the structural elements of the apparatus remain substantially free from condensates from the cigarette smoke and the apparatus can be reused without any necessity for cleaning.

The exhale filter cartridge 36 comprises an elongate assembly 65 of a tobacco smoke filter material, similar to that described above for the filter element 54, preferably including a highly-efficient low pressure drop smoke filter material 66 which removes substantially all particulate material from exhaled smoke, so that only substantially invisible gaseous cigarette smoke components pass therethrough. A low pressure drop smoke filter material, such as described above for the filter element 58 may be used. To provide support for the filter element 65, there is provided an inner layer of coarse filter material 68 and an outer porous mesh material 67 providing a crimped end closure 70 for the exhale smoke filter element 36. The end closure 70 seals off the end of the filter to ensure that smoke exhaled into the exhale filter travels radially through the filter. The tobacco smoke filter material 68 also may be used without any support.

A replaceable mouth-piece 72 is provided to facilitate exhale of the smoke into the interior of the cartridge 36. A mouth piece holder 74 is joined to the filter structure 65 in any convenient manner, such as by cigarette tipping paper 76. By using such low pressure drop filtration material, there is little resistance to exhale, so that the exhale by the smoker through the filter approximates a normal exhale action. The filtered exhale smoke is discharged through the slots 42 in the side wall of the enclosure 34. The construction of the exhale filter cartridge 36 may be of similar dimensions to the sidestream smoke filter cartridge 32. The construction of the mounting element may be of similar design to the mounting element for the sidestream filter. The dimension of the exhale smoke filter cartridge 32 also may be sized to fit inside the cigarette tube 52 to facilitate efficient packing of the elements.

While the smoking apparatus 10 is constructed to provide for disposal of both sidestream smoke and exhale smoke within the same unit, it is possible to provide a construction which only disposes of sidestream smoke, by omitting elements associated with capturing exhale smoke. Under such circumstances, exhale smoke may be discharged to atmosphere, or a separate device may be provided for filtering exhale smoke prior to discharge as described with respect to the embodiment of FIG. 14. Alternatively, the illustrated device may be employed with the opening 38 plugged.

In the housing 12, the fan 24 draws fresh air into the unit through bores 48 in the cigarette tube mounting element 46, and through the tube 52 as shown in FIG. 7. The cigarette tube mounting element 46 has a circular recess 45 of an internal diameter slightly greater than the external diameter of the cigarette tube 52. Hence, the mounting element 46 can be inserted over the tube end 53 to provide a friction fit of the tube in the mounting element 46. The burning cigarette is held in the cigarette tube by the cigarette holder 50. The incoming air passes over the burning cigarette and then through the filter element 54 into the enclosure chamber 30. The filter chamber 54 removes sidestream smoke from the vicinity of the burning cigarette and filters the same. Filtered air is discharged from the smoking apparatus 10 through the activated carbon filter 44. The flow of air through the filter cartridge 32, as well as removing sidestream smoke, ensures an adequate supply of fresh air for proper burning of the cigarette in the tube 52 and a reduction in the heat surrounding the cigarette to prevent scorching of the paper and drawing of the hot air from the enclosure by the smoker while smoking the cigarette. This arrangement ensures that smoking of the cigarette in the smoking apparatus 10 provides the same cigarette taste as normal smoking.

The smoker exhales cigarette smoke through the exhale filter cartridge 36. The filtered smoke passing through the filter element 65 is discharged through the activated charcoal filter 44. While the smoking apparatus 10 provides for separate filtering of sidestream and exhale smoke, it is possible to provide a construction in which the sidestream smoke and exhale smoke are filtered by the same filter element within a housing.

FIG. 8 contains a variety of configurations of mounting elements 46 with varying orientation and distribution of bores 48 therethrough and cigarette holders 50 which may be used in the smoking apparatus 10. The cigarette holder 50 and the mounting element 46 also may be of one-piece construction.

Figures 8A, 8B, 8C, 8D, 8E, 8F, 8G, 8H, 8I, 8J, 8K, 8L, 8M, 8N, 8O:
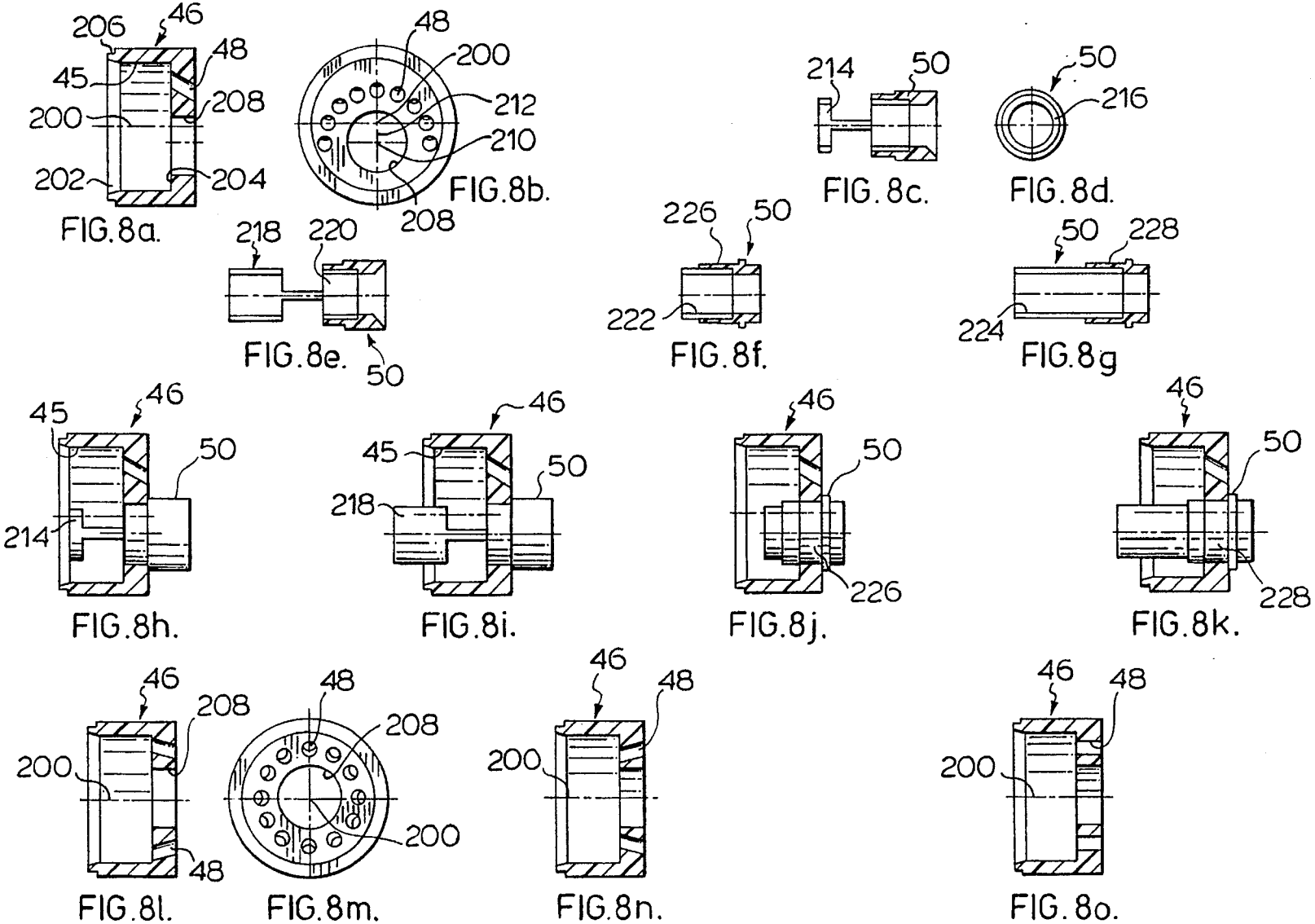

As shown in FIGS. 8A and 8B, the mounting element 46 has the bores 48 inclined relative to the central axis 200 of the mounting element. The recess 45 has a slight chamfer 202 at its entrance to facilitate the insertion of the end of the cigarette tube into the recess 45. The cigarette tube slides along the recess 45 and the end of the tube bottoms out on the base 204 of the recess 45. On the exterior of the mounting element 46 is an annular ledge 206 which is provided for purposes of friction fit within the opening 33 of the sidestream front end 35.

The cigarette holder 50 is inserted in the bore 208 of the mounting element 46. The bore 208 is offset from the central axis 200. As shown in FIG. 8B the centre of the bore 210 is offset by the distance 212. This offset positions the cigarette in the lower portion of the cigarette tube 52 to provide an increased air space above the cigarette within the cigarette tube. The purpose of the offset arrangement is described in more detail with respect to FIGS. 21 through 23.

As shown in FIGS. 8C through 8G, a variety of cigarette holders for positioning in the bore 208 of the mounting element 46 are provided. The purpose of the various cigarette holders is to hold varying diameters of cigarettes as well as various mounting arrangements for positioning the cigarette holder in the bore 208. The cigarette holder insert 50 has a clip portion 214 which further supports the cigarette within the cigarette tube. The clip 214 may be formed of metal which may also serve a temperature sensing function, as described with respect to FIGS. 9D through 9G. As shown in FIG. 8D, the holder 50 has a tapered surface 216 to permit insertion of the cigarette into the holder 50. The holder 50 of FIG. 8E has an enlarged clip portion 218 which in addition to supporting a cigarette in the cigarette tube provides for greater heat transfer to the portion 220 within the holder 50.

The cigarette holders 50 of FIGS. 8F and 8G may have cylindrical inserts 222 and 224. Those inserts may be of plastic or metal to provide support for the cigarette within the cigarette tube.

As shown in FIGS. 8H and 8I, the cigarette holders 50 are inserted in the mounting elements 46 where the metal clip portions 214 and 218 are positioned in the recess area 45 of the respective mounting element. Similarly with FIGS. 8J and 8K, the respective cigarette holder 50 of FIGS. 8F and 8G are inserted. The shoulders 226 and 228 of the respective cigarette holder are used to press fit the holder within the respective mounting element 46.

In FIGS. 8L through 80 various bore configurations are shown in the mounting element 46 of FIG. 8L. The bore 208 for receiving the cigarette holder is concentric with the central axis 200. The fresh air inlets 48 are sloped relative to the central axis 200 where they converge in a direction away from the exterior of the holder 46. The central location of the bore 208 is shown as well in FIG. 8M where the fresh air inlets 48 are located concentrically about the central axis 200. In FIG. 8N the fresh air inlets 48 slope relative to the central axis 200, only they converge in a direction away from the interior of the holder 46. In FIG. 8O the fresh air inlets 48 are again concentric about the central axis 200, only they extend parallel to the central axis 200 and do not converge. The various orientations for the fresh air 48 provide to some degree a directional flow for the fresh air as it enters the cigarette tube. Depending upon the flow rates of the fresh air along the cigarette tube, it may be desired to either direct the fresh air outwardly along the cigarette tube face to enhance cooling of the cigarette tube or it may be desired to direct the fresh air toward the cigarette to minimize scorching of the cigarette paper. It is also appreciated that the cigarette holder may not extend appreciably beyond the outside of the mounting element 46. This arrangement ensures that the user extends the filter tip sufficiently beyond the holder to permit contact of the filter with the user's lips.

In experimentation with smoking apparatus of the type seen in the drawings, it was found that if a cigarette was smoked in such a way that the fireball came near the opening of the cigarette holder 50, the following puff of the cigarette was very hot and unpleasant. In one aspect of the smoking apparatus, provision is made for sensing the position of the fire ball within the tube 52 and providing a signal to the smoker to smoke the cigarette no further.

Figure 9D:
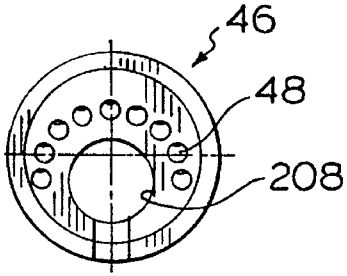
FIGS. 9A through 9G show various cartridge mounting elements, cigarette holders and temperature sensing elements.
Figure 9E:
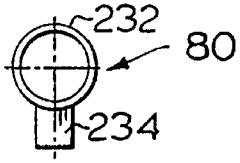
Figure 9G:
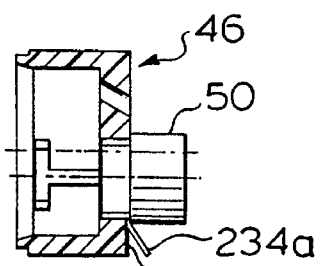
Figure 9F:
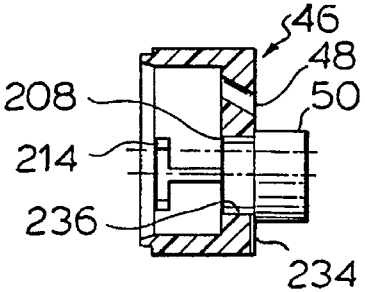
Figure 9B:
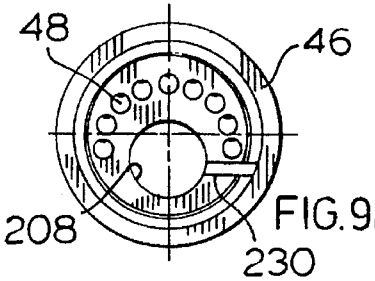
Figure 9C:
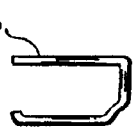
Figure 9A:
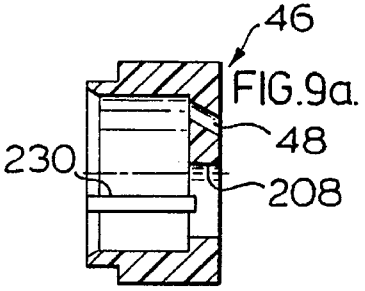

In FIGS. 9A to 9C, one approach is illustrated, wherein a thin U-shaped temperature sensor 78 is fitted in the slot 230 of the mounting element 46. The sensor 78 provides a signal to electronic elements of the system when the temperature sensor senses an increased temperature, so as to activate an audible or visual alarm to the smoker.

In FIGS. 9D to 9G, a bimetallic strip 80 is shown for mounting in the cigarette holder/mounting element 46. The bimetallic strip 80 has a ring portion 232 with a depending tab 234. The ring portion 232 fits over a shoulder 236 of clip 214. The holder 50 with clip and ring in place is fitted into the bore 208 with the depending tab 234 on the exterior surface 238 of the element 46. The clip 214 senses in advance the heat of the cigarette ember which is conducted along clip 214 to shoulder 236 and is transferred to the bimetallic strip 80. The increase in temperature in the tab 234 causes it to swing outwardly to position 234a. The change in position of the tab 234 provides a visual warning to the smoker that the "end of cigarette" has been achieved and the smoked cigarette discarded preferably in the manner to be described with respect to FIG. 26.

The location of the fireball may also be sensed by temperature-sensitive chemical materials installed in the body of the side assembly 26. These materials sense increased temperature of the cigarette holder 50 created by the approaching fireball and change colour. An example of a temperature sensitive strip which indicates temperature by its colour is described in U.S. Pat. No. 5,154,192. Such colour change is visible on the outside of the side assembly 26 and provides a visual warning to the smoker.

In use of the smoking apparatus 10, a cigarette is lit by a smoker and inserted into the cigarette holder 50 with the mounting element 46 assembled with the filter cartridge 32 and mounted in opening 33. The cigarette is smoked normally through its filter and exhale smoke is discharged by the smoker through the exhale filter cartridge 36. The fan 24 is activated by an on-off switch.

Figure 11:
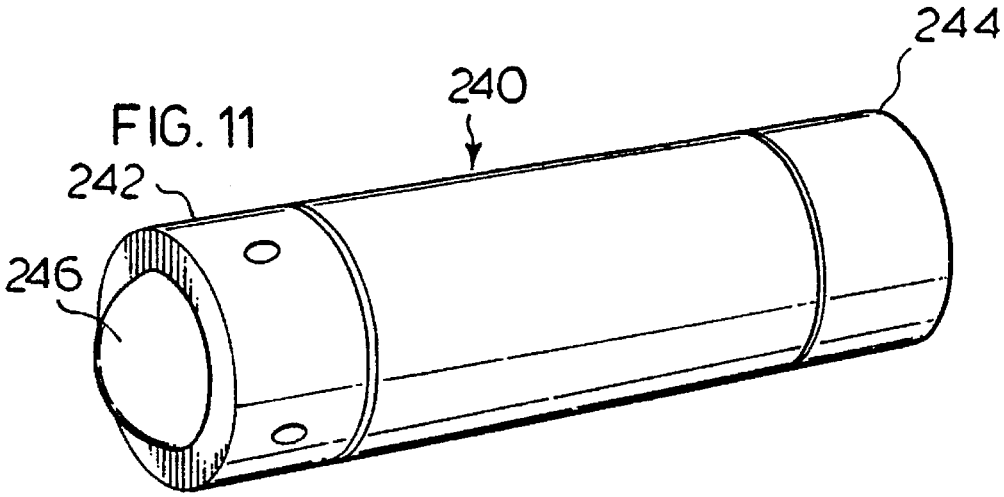
FIG. 11 shows a flameless lighter construction which may be used in conjunction with the smoking apparatus of the invention.
Figure 12:
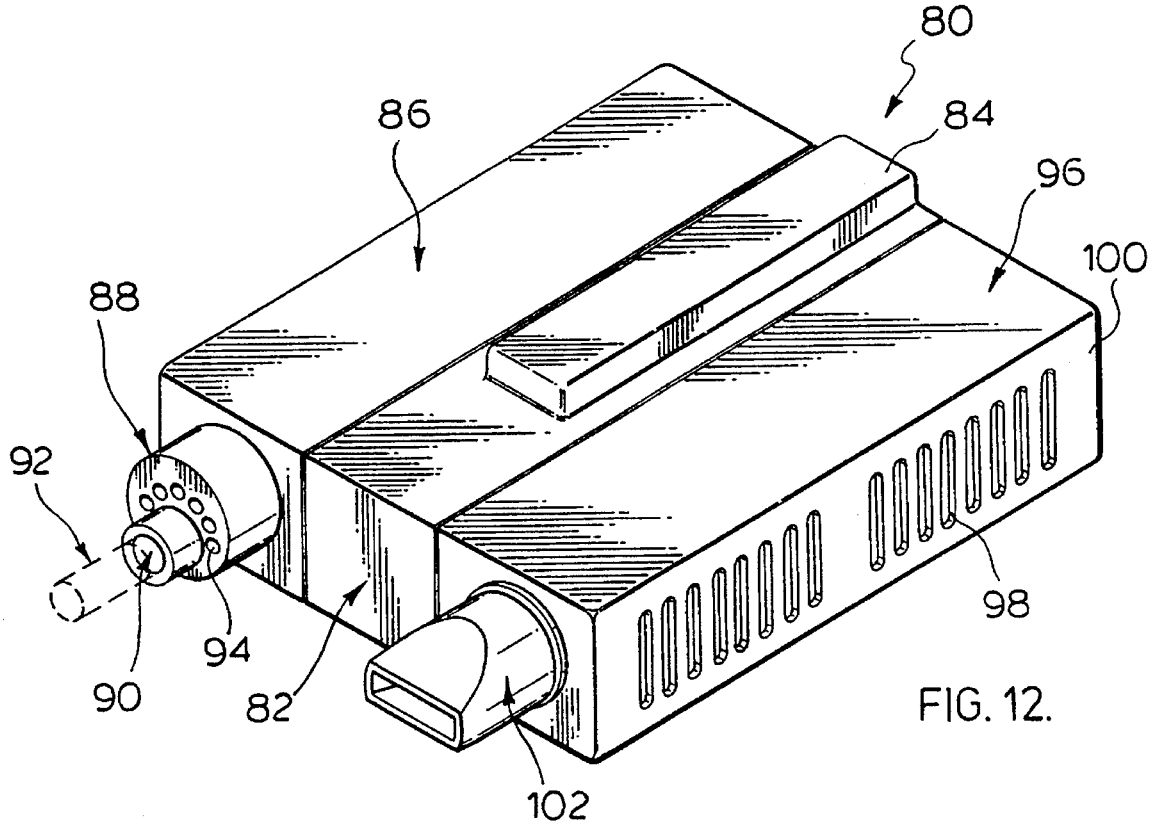
FIG. 12 is perspective view of an alternative embodiment for a smoker's accessory capable of filtering both sidestream cigarette smoke and exhale cigarette smoke.

Alternatively, the smoking apparatus 10 may be provided with a flameless lighter to enable the cigarette to be lit while located within the unit. In this regard, a variety of structures of flameless lighters are known. Such devices generally require a source of fuel and an ignition catalyst, with some means of bringing fuel and catalyst into contact. One form of device is seen in FIG. 11, which employs an air pump to activate the generation of heat. The fuel cell 240 has a pump 242 and ignition module 244. The fuel cell is positioned in the smoker's accessory 10 in a manner, such that, when activated, it directs a stream of hot gases at the end of the cigarette to ignite same. The fuel cell is then turned off by releasing switch 246.

Electronics, which will be discussed in more detail in relation to FIG. 20, may be provided with the smoking apparatus 10. The electronics enable, following activation of the electronic circuitry, fan start-up to be effected automatically when the temperature in the tube 52 reaches a target value, to maintain the fan operational while the tube maintains an operating temperature, to provide for visual and/or audible indication that the cigarette has been smoked and, after extinguishing of the cigarette, to maintain the fan in operation to cool down and vent the unit with clean outside air.

An alternative for the smoker's accessory is described in respect of FIGS. 12 through 30. The smoker's accessory 80 comprises a central body 82 which includes the exhaust fan, the rechargeable battery 84, the switch for turning the unit on and off and the related electronics for controlling the operation of the unit. The sidestream smoke filter cartridge is housed in housing 86. The cigarette holder 88 holds a cigarette 90 with the filter tip portion 92 exposed so that the user may place their lips on the cigarette and inhale in the normal manner. Apertures 94 are provided in the cigarette holder 88 to provide for the entrance of fresh air to within the sidestream smoke filter cartridge to balance a pressure drop created in housing 86 due to a user inhaling on the cigarette or the fan exhausting air from the housing.

The exhale smoke filter cartridge is housed in housing 96. The housing 96 has a grill portion 98 in the sidewall 100. A mouth piece 102 has an exhale filter connected thereto. The user can place his mouth on the mouth piece 102 and exhale into the exhale filter cartridge. The sidestream smoke, as filtered in housing 86 is exhausted into the housing 96. Both the filtered sidestream smoke and filtered exhale smoke is then released to the surroundings through grill 98.

Figure 13:
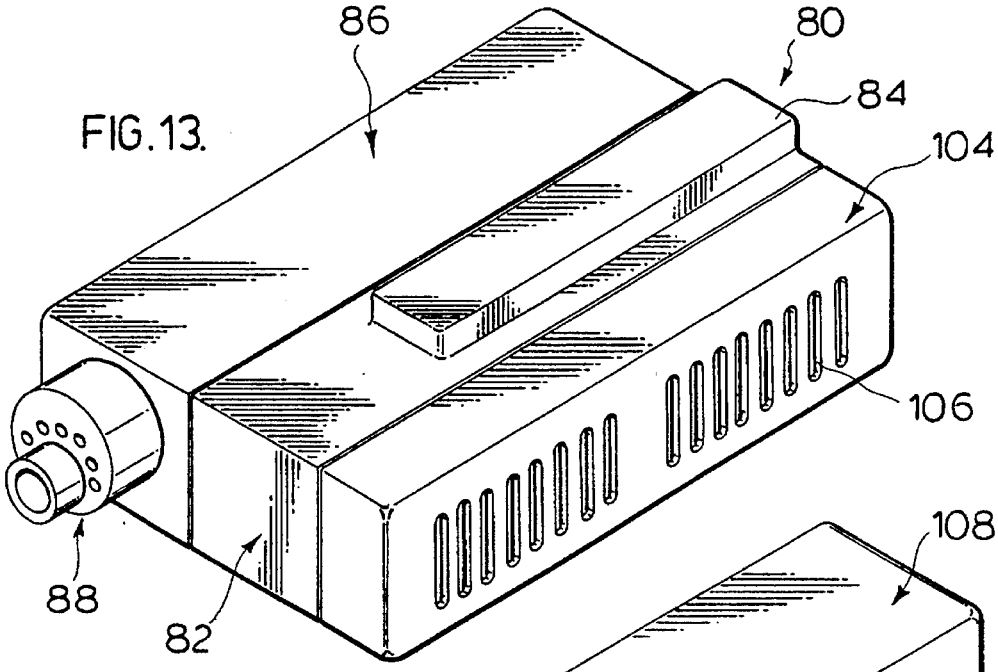
FIG. 13 is a modification of the embodiment of FIG. 12 which is adapted to only filter sidestream smoke.

As shown in FIG. 13, an embodiment of the invention contemplates the basic version of the smokers's accessory 80 with the sidestream smoke filter cartridge and housing 86 and cigarette holder 88. The central body 82 is the same with the rechargeable battery 84. However, the unit does not have the exhale filter portion. Instead, a decorative grill 104 is connected to the central body portion 82 and is provided with a grill openings 106 through which the filtered sidestream smoke may be exhausted. In this circumstance the user may simply exhale smoke to the surroundings or may use an exhale filtering device held in the other hand for filtering exhaled cigarette smoke.

Figure 14:
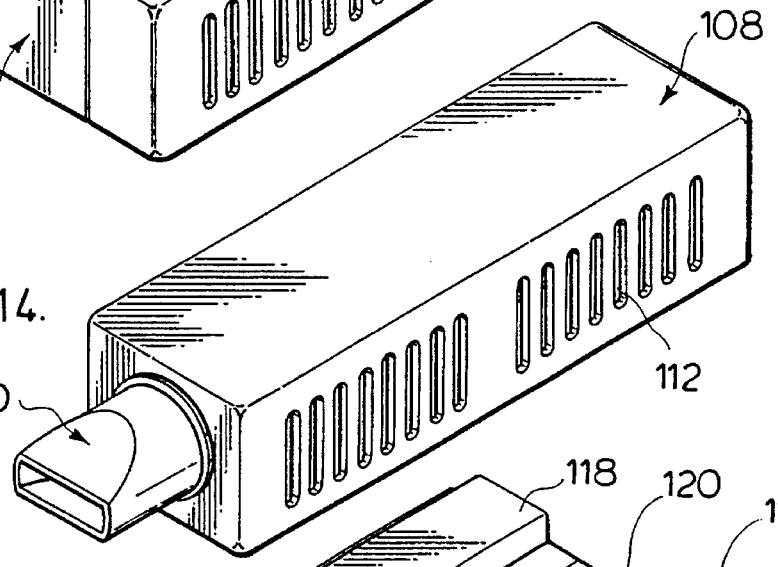
FIG. 14 is a perspective view of a unit for filtering exhale smoke.

An example of an independent exhale filter unit is shown in FIG. 14. An exhale smoke filter cartridge is housed in housing 108. The exhale filter cartridge is connected to a mouth piece 110. The housing 108 includes a grill 112 with all other sides being solid. The user may readily carry the exhale smoke filter device in hand which may facilitate use of the sidestream smoke filtering device held in the other hand.

Figure 15:
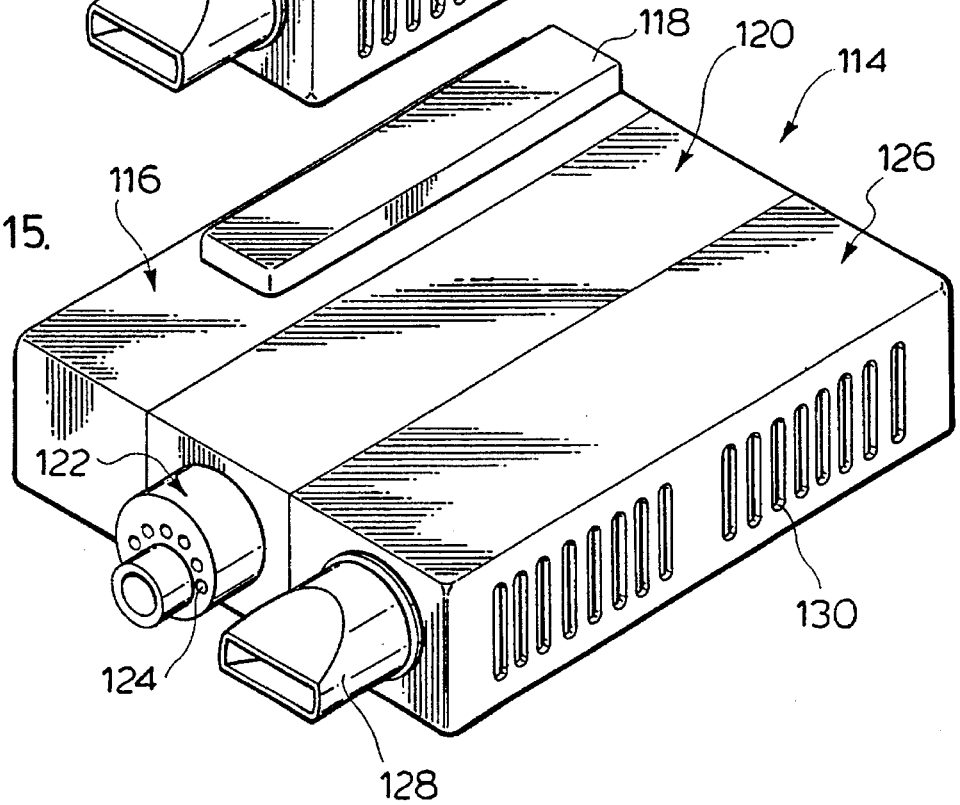
FIG. 15 is a perspective view of an alternative arrangement of the smoker's accessory of FIG. 12.

In view of the exhale smoke filter cartridge operating independently of the sidestream filter cartridge, such exhale smoke filter cartridge may be located on any part of the sidestream filter unit of FIG. 13. As shown in FIG. 15, according to this particular embodiment, the smoker's accessory 114 has a body portion 116 which carries the rechargeable battery 118 as well as the fan for drawing air from the housing 120 for the sidestream cigarette smoke filter. The housing 120 has a cigarette holder 122 secured thereto as with the other embodiments. The fan in the body portion 116 draws fresh air into the cigarette tube through the opening 124 and the fan then exhausts the cigarette smoke to the surroundings immediately adjacent the body portion 116. The exhale smoke filter is housed in housing 126 to which a mouth piece 128 is attached. The filtered exhale smoke is then released to the surroundings through grill 130.

The embodiments of FIGS. 13, 14 and 15 demonstrate the flexibility in the design and use of the smoker's accessory in accordance with this invention.

Figure 16:
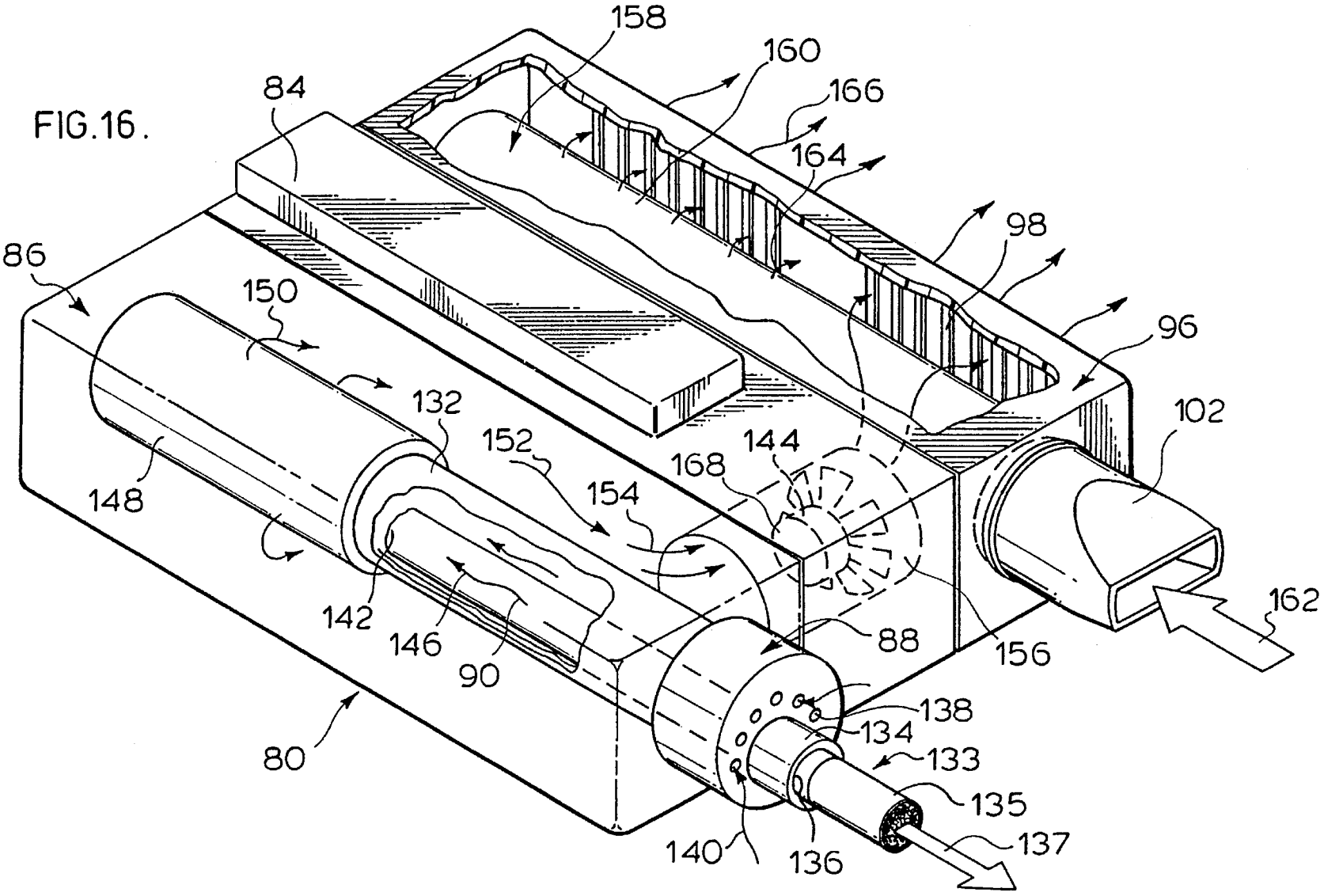
FIG. 16 is a perspective view of the smoker's accessory of FIG. 12 having portions of the housing removed to demonstrate the air flow through the smoker's accessory.

The cutaway view of the smoker's accessory 80, as shown in FIG. 16, demonstrates in further detail the manner in which the fan exhausts the filtered sidestream smoke. The sidestream smoke filter cartridge 86 comprises a cigarette tube 132 in which a lit cigarette 90 may be placed. The lit cigarette 133 may be inserted in the cigarette tube 132 by passing the lit cigarette through the cigarette holder 88 which has an insert 134 having a bore 136 therein through which the cigarette 90 is pushed to locate the lit cigarette in the cigarette tube 132. The lit cigarette 133 is pushed into the cigarette tube until only the filter tip 135 projects outwardly of the holder 88. The user may then smoke the cigarette in the normal manner by inhaling on the filter tip 135 to draw smoke away in the direction .of arrow 137. The cigarette holder 88 is provided with a plurality of openings 138 through which fresh air is drawn. The fresh air travels in the direction of arrows 140 along cigarette 90 and over the lit ember 142. The fresh air is drawn through the opening 138 by the operating fan 144. The sidestream smoke as picked up by the fresh air 146 travels through the filter element 148 in the direction of arrows 150 and along the interior of the housing 86 in the direction of arrows 152 and into the inlet of the fan 144 in the direction of arrows 154. Since the smoke has been filtered of particulate material and optionally of the gaseous components, the fan may exhaust the air through its outlet 156 and through the grill portion 98 of the housing 96. If the filter element 148 only filters out the particulate material then a second filter element may be provided which removes the gaseous components. That second filter element may be provided over the particulate filter cartridge 148 or it may be provided at the grill 98 of the exhale filter housing 96.

The fan flow rates may vary depending on fan shape and motor power. It is appreciated that the fan is powered most conveniently by an electric motor. However, the motor may be a wind up mechanical spring drive or a flywheel having a starting device. It is appreciated that the fan selection is such to provide a flow rate which removes the sidestream smoke from the tube to ensure desired smoking taste and flavour. The selected flow rate is not too high because a high flow-rate expedites cigarette burn rate to an extent which decreases the number of puffs per usual smoking period to an unacceptable low number.

The exhale filter cartridge 158 has a filter element 160 with the mouth piece 102 attached thereto. The user exhales in the direction of arrow 162 into the mouth piece and the exhaled air travels through the filter in the direction of arrows 164 and then to the surrounding 166 by passage through the grill 98. The fan 144 may be provided with an electric motor 168. In view of the portability of the unit the electric motor 168 may be powered by the rechargeable battery pack 84. A suitable switch may be provided on the central unit 82 for turning the fan on and off. Details of the operation of the smoker's accessory in respect to its electrical controls is described in more detail in respect of FIGS. 19 and 20.

Figure 17:
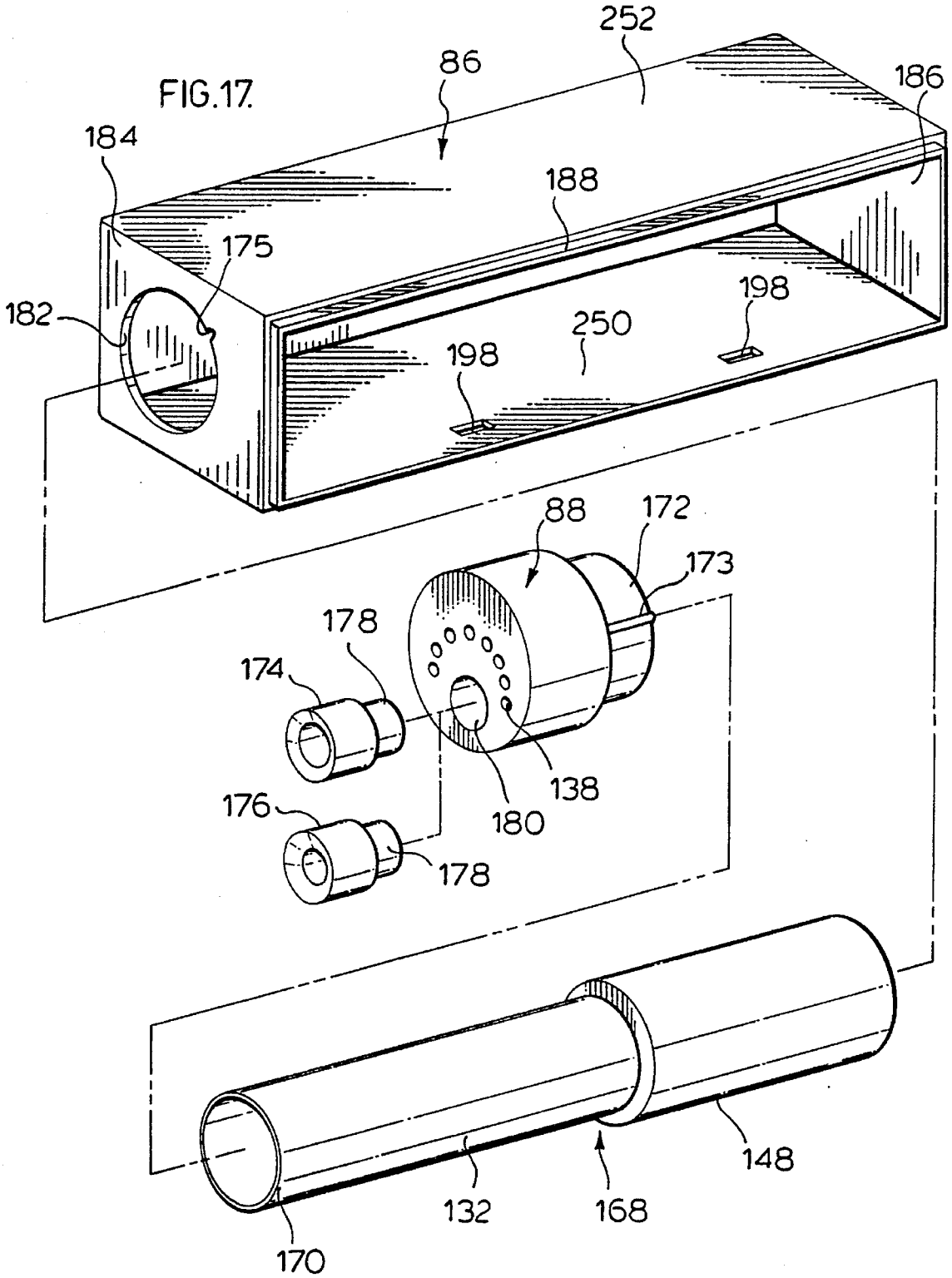
FIG. 17 is an exploded perspective view of the sidestream smoke filter cartridge assembly.
Figure 18:
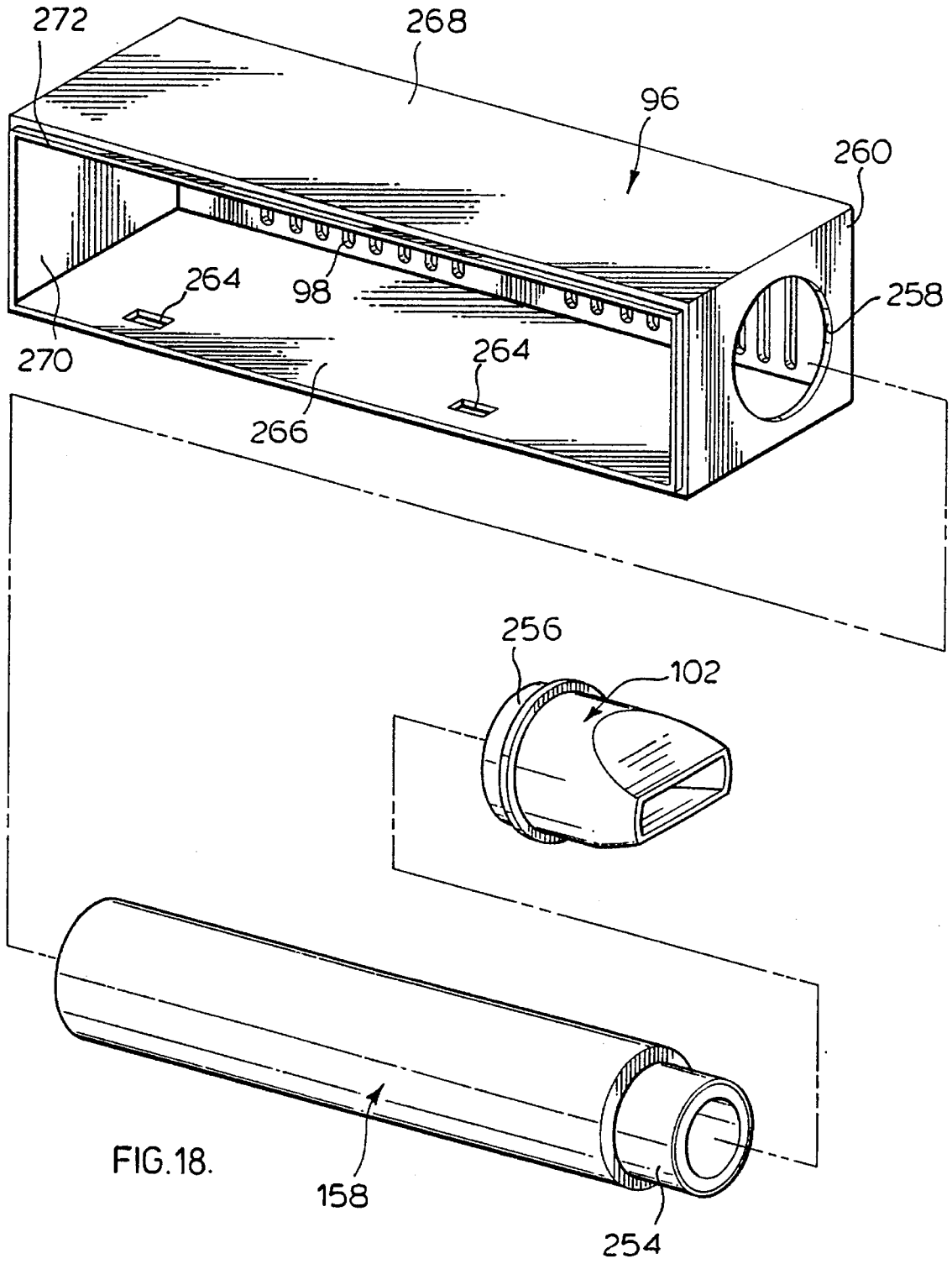
FIG. 18 is an exposed perspective view of the exhale smoke filter cartridge assembly.

The assembly of the sidestream filter and the exhale filter is described in respect of FIGS. 17 and 18. The sidestream filter cartridge 168 comprises the filter element 148 and the cigarette tube 132. The end portion 170 of the cigarette tube fits within the cigarette holder 88. A collar 172 has an internal diameter slightly larger than the external diameter of the end 172 of the cigarette tube. As with the embodiments of FIG. 8, two different sizes of cigarettes are accommodated by inserts 174 and 176 having reduced shoulders 178, either of which is press fitted in the bore 180 of the cigarette holder mounting unit. The apertures 138 are provided to introduce fresh air to within the cigarette tube 132. The diameter of the filter unit 148 is less than the diameter of the opening 182 in the front wall 184 of the housing 86 for the sidestream filter cartridge. This permits assembly of the holder 88 on the end 170 of the filter cartridge before it is placed within the housing 86 by inserting it through the opening 182. It is understood however that if it is necessary to provide a filter unit 148 that is larger in diameter than the opening 182 the cigarette holder 86 may be removed from the opening 182 and the sidestream smoke filter cartridge be removed through the opening 186.

A ridge 188 is provided around the perimeter of the opening 186. The ridge fits within a corresponding groove on the side of the central unit 82 as shown in FIG. 19. The groove 190 extends around the side 192 of the central body portion 82. The side 192 has the inlet 194 for the fan 144. On the side 192 are depressible detents 196 which are snap fitted into the depressions 198 in the bottom wall 250 of the housing 86. Similar depressions are formed in the underside of the top wall 252 to receive the corresponding upper detents 196 on the side wall 192. Hence, the housing for the sidestream smoke filter cartridge is readily connected to and removable from the central component 82. In this particular embodiment the detents, in combination with the depressions 198 provide for a quick snap connection of the housing 86 to the central unit 82. Furthermore, a seal is ensured for the housing by ridge 188 fitting within the groove 190 to ensure that all sidestream smoke drawn through the filter unit 148 passes to the fan inlet 194.

The exhale filter arrangement is somewhat similar to that for the sidestream filter arrangement. A housing 96 is provided for the exhale filter cartridge 158. The filter cartridge 158 is tubular in nature with a reduced end portion 254. The mouth piece 102 has a collar 256 with an internal diameter slightly greater than the end portion 254 of the exhale filter element 158. The end portion 254 is inserted in the mouth piece 102. The diameter of the filter unit 158 is slightly less than the diameter of the opening 258 in the housing front wall 260. This permits positioning of the exhale filter unit in the housing 96. The housing 96 can be releasably connected to the central body portion 82 by way of detents 262 snapping into the depressions which are provided in the lower wall 266 at positions 264. Similar depressions are provided on the underside of the upper wall 268 to receive the corresponding depressible detents 262. Around the perimeter of the opening 270 of the housing 96 is a ridge 272. The ridge 272 is received in a groove in the other side wall of the central body portion 82 to form a seal to ensure that while the fan is operating that all filtered exhaled smoke is introduced to the surroundings through the grill elements 98.

As shown in FIG. 19, the central body portion 82, which houses and supports the fan 144, has the rechargeable battery pack provided therein. The rechargeable battery pack may be removed from the unit 82 for purposes of charging. The battery pack is provided with charging terminals 274. Instead of removing the battery pack for purposes of recharging, the entire unit can be set on a cradle or the like, as shown in FIG. 10, where the cradle has terminals which connect with the recharging terminals 274 for the battery. It is appreciated that the appropriate electronic circuitry is included in the rechargeable battery system such that if contact is made across terminals 274 the battery will not discharge.

As shown in FIG. 20, the central body 82 has an integrated circuit 276 to which the fan is connected via lead 278 and to which the batteries are connected via lead 280. The rechargeable terminals 274 are shown as connected to the battery pack 282 via leads 284. Also provided within the smoker's accessory 80 is a first temperature sensor 286 and second temperature sensor 288. A rate of air flow sensor is provided at 290. As described with respect to the first embodiment of this invention, the electronic circuitry of this invention performs several controlling functions. Instead of the temperature sensors visually indicating "end of cigarette" by either a bimetallic tab moving or a colour change, this can be accomplished with the controller circuit 276. The first temperature sensor 286 senses when a lit cigarette is placed in the cigarette robe 132. The temperature sensor 286 may be any of the well known types of thermal couples which develops a signal for the controller through lead 292. Similarly, temperature sensor 288 is connected to the circuit 276 via lead 294. Temperature sensor 288 senses the "end of cigarette" to signal the user that it is time to remove the lit cigarette from the smoker's accessory 80. Circuitry 276 may be equipped to power an audible and/or LED to signal the user with either or both a lamp being lit and a buzzer being sounded. Furthermore, temperature sensor 286 in determining the presence of a lit cigarette can also actuate a signal that the fan is malfunctioning or the switch shown in dot at 296 has not been mined on to actuate the fan 144. Similarly, temperature sensor 288 upon sensing "end of cigarette" can actuate through the circuit 276 a visual and/or audible indicator to signal removal of the lit cigarette. The system may also be automated to turn the fan on automatically when temperature sensor 286 senses a lit cigarette and automatically shut the fan off approximately two minutes after the sensor 288 senses end of cigarette. The continued operation of the fan is desired to clear any smoke remaining after the lit cigarette is removed.

The filter cartridges for the sidestream smoke and the exhale smoke should be replaced from time to time. For most applications the filters would be changed every 12 to 20 cigarettes smoked. If the user forgets to replace the cigarette filters, a drop in efficiency of the filters results by virtue of the filter becoming clogged. The clogged filter develops higher and higher pressure drops where the air flow sensor 290 senses when the flow of air, as generated by the fan 144, drops below a predetermined minimum. That is normally due to overclogged filter elements or perhaps a malfunctioning fan. In either event, when the air flow drops below a predetermined minimum as sensed by the air flow rate sensor 290, the circuitry as connected to the sensor 290 via lead 298 provides a visual and/or audible alarm to change the filters or check the operation of the fan 144.

Figure 21:
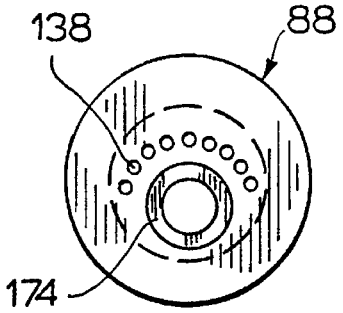
FIG. 21 is an end view of the cigarette holder for the sidestream filter cartridge.
Figure 22:
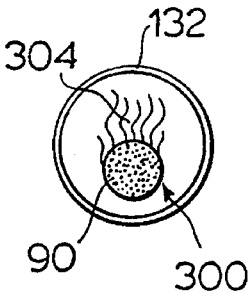
FIG. 22 is a section through the cigarette tube of the sidestream filter cartridge.

It is appreciated that with the sophistication of the electronics in the circuit 176, there are several diagnostic and monitoring functions which may be performed to always ensure optimum performance for the smoker's accessory 80. As discussed with respect to FIG. 8 the cigarette holder 88 which includes an insert 174 for holding a lit cigarette is offset from the central axis of the cigarette holder body portion 88. The purpose of offsetting the insert 174 is to position the lit cigarette in the lower portion of the cigarette tube. As shown in FIG. 22, the cigarette tube 132 has the lit cigarette 90 positioned in the lower region, generally designated 300 of the cigarette tube 132. The smoker's accessory 80 may be provided with feet to ensure that when the user sets the unit down on the table, the cigarette 90 is lowermost in the tube 132, that is the insert 174 is in the relative position shown in FIG. 21. To ensure that insert 174 is always lowermost with respect to the tube 132 when the unit is set down on the table or the like, a locator device may be located on the collar 172 of the cigarette 88, as shown in FIG. 17. A protrusion 173 which when aligned with a recess 175 in the opening 182, always locates the cigarette holder insert 174 lowermost, as shown in FIG. 21.

It is also appreciated that the fan speed may also be varied slightly by a suitable switch in conjunction with the electronics. Such variance of the fan speed may be desired to compensate for cigarettes of different densities from different countries. Dense cigarettes have a slower burn rate so that fan speed may be slightly increased to ensure sufficient fresh air flow rate to maintain the slower burn rate without affecting taste and flavour. The converse applies, of course, for the less dense cigarette.

Figure 23:
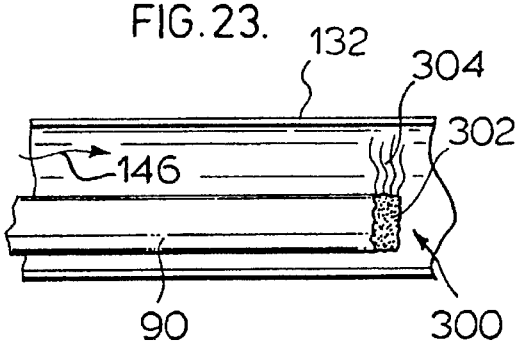
FIG. 23 is an elevation section of the cigarette tube in which a lit cigarette is placed.

In FIG. 23, the lit cigarette 90 is shown in the lower portion 300 of the cigarette tube 132. The heat from the cigarette ember 302 rises, as shown by lines 304. Air drawn into the cigarette tube 132, travels in the direction of arrow 146. As previously discussed with respect to FIG. 16, the fresh air is brought in through apertures 138 of the cigarette holder. The air flows along the cigarette 90 and picks up the sidestream cigarette smoke rising in region 304. The movement of the air cools the region above the cigarette 90 and as well cools the cigarette tube 132. Such cooling action avoids the cigarette ember 302 overheating the cigarette tube 132. Furthermore, the fresh air in cooling the cigarette tube 132 prevents heat build-up so as to avoid charring of the cigarette paper and thereby maintaining the usual taste and flavour of the smoked cigarette.

Figure 24:
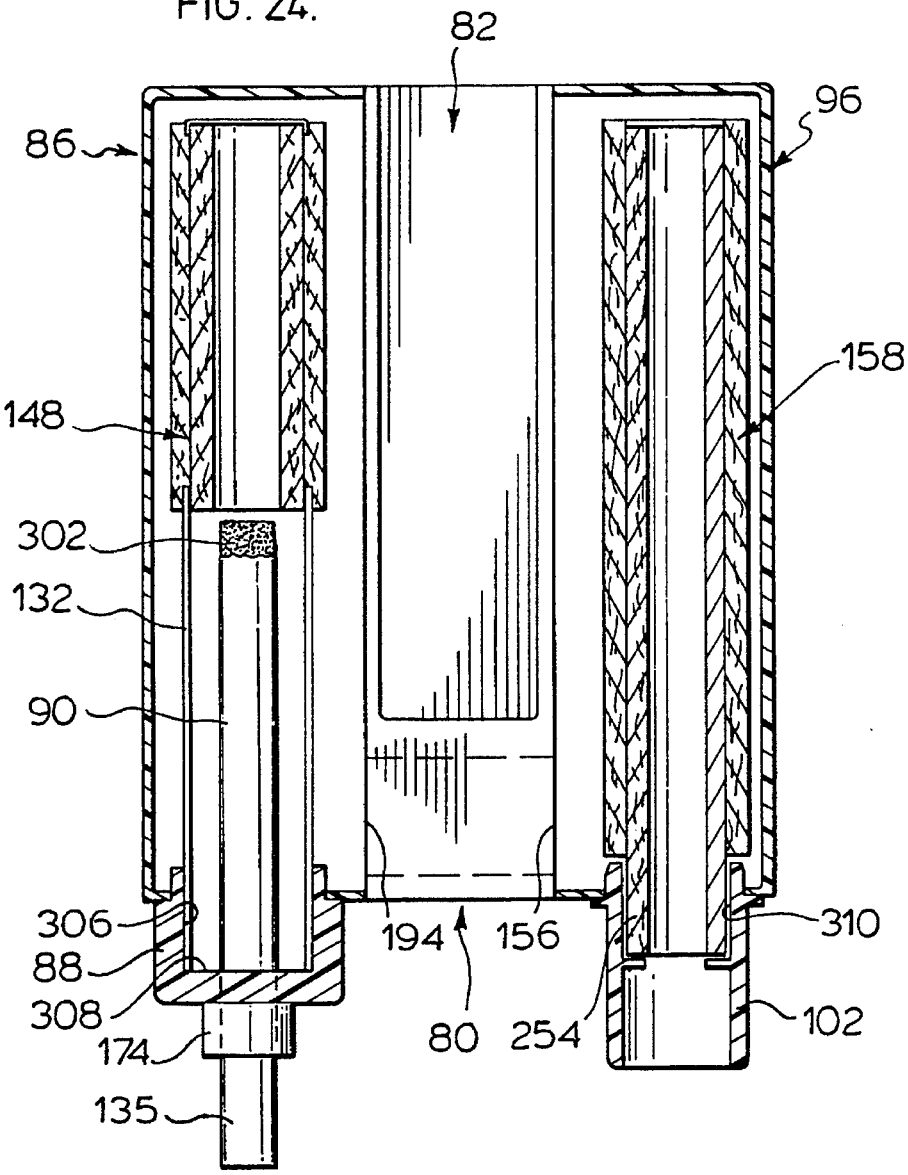
FIG. 24 is a horizontal section through the smoker's accessory of FIG. 12.
Figure 25:
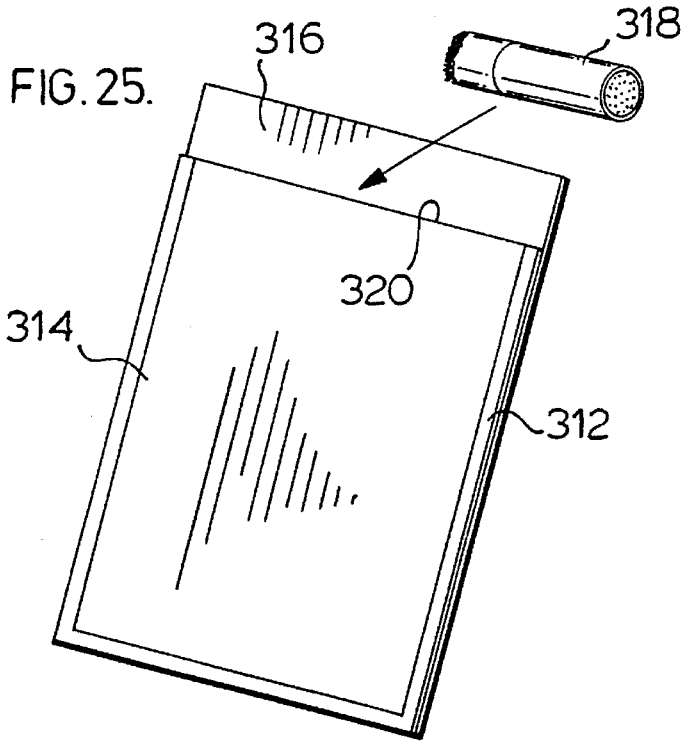
FIGS. 25 and 26 are perspective views of a pouch used in distinguishing the cigarette removed from the smoker's accessory.

The relative proportions of the various components of the smoker's accessory is shown in FIG. 24. The lit cigarette 90 as inserted through the insert 174 extends along the cigarette tube 132 to an extent that is short of the filter unit 148. The end of the cigarette 90 preferably does not contact the filter element 148 to avoid the heat of the cigarette ember 302 destroying the physical characteristics of the filter element 148. The housing 86 is the same length as the central body portion 82 where the front face of the housing carries the cigarette holder 88. The cigarette holder serves the function of holding the cigarette by way of the insert 174. The bore within the insert is such to receive snugly the cigarette and maintain the filter portion 134 external of the holder. The cigarette holder also has the recess portion 306 which has an internal diameter slightly greater than the diameter of the end portion of the cigarette tube 132. The cigarette tube is inserted down to the base 308 of the recess to ensure a secure fitment of the end of the cigarette tube within the holder 88. With such secured fitment of the end of the cigarette tube in the holder 88, the cigarette tube can be suspended within the housing 86 where the cigarette tube does not contact the interior of the housing. In this manner, the distal end of the cigarette sidestream filter cartridge does not have to be supported. Although with certain arrangements support may be provided by a device within the enclosure 86 receiving the filter end to support it and preventing it from becoming dislodged from the holder 88. The friction fit for the end of the cigarette within the holder 88 is sufficiently air tight to prevent any cigarette smoke escaping from within the cigarette tube, hence all sidestream smoke is pulled through the filter element 148 before discharge to the surroundings.

Similarly, the exhale filter cartridge 158, to which the mouth piece 102 is connected, is suspended in the housing 96. The mouth piece 102 has a recess 310 which snugly receives the reduced end portion 254. The friction fit of the reduced end portion 254 in the recess 310 secures the exhale filter element 158 within the housing 96. As with the sidestream filter element, if support is required at the distal end of the filter, a suitable support may be provided within the housing to receive loosely the distal end of the filter.

In respect of the relative proportions of the size of the cigarette tube to the size of the cigarette 90, the ratio of the diameter of the two have a bearing on the flavour and taste of the inhaled smoke. One of the difficulties with the prior art devices is that the cigarette tube was usually less than 1¼ times the diameter of the cigarette. Hence, the cigarette tube was very close to the paper of the cigarette. It has been found that with such constricted space between the cigarette tube and the cigarette, the cigarette would normally overheat and significantly affect flavour and taste. It has been found however, with the arrangement in accordance with this invention, that making the cigarette tube with an inner diameter at least about 1.5 times the diameter of the cigarette, the taste and flavour of the cigarette is greatly improved.

As shown in FIG. 22, the cigarette tube 132 is slightly greater than 2 times the diameter of the cigarette to ensure sufficient space such that the cigarette paper nor the cigarette tobacco overheats during the smoking process. The flow rate provided by the fan 144 is sufficient to ensure that incoming fresh air in the direction 146 of FIG. 23 maintains the cigarette at a proper temperature, that temperature being similar to the temperature of the cigarette when smoked in a normal environment.

Figure 26:
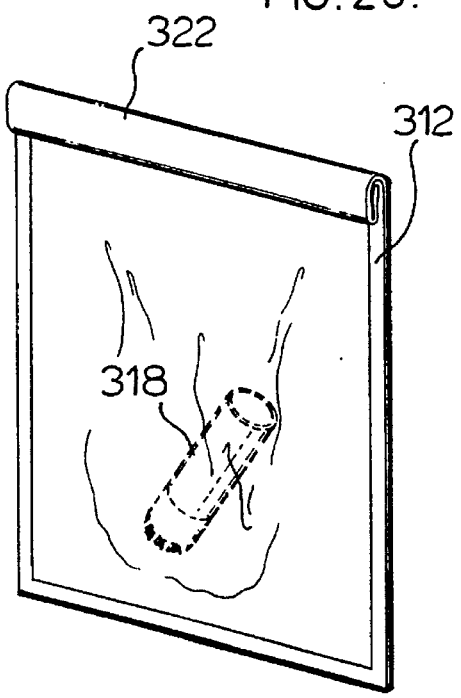

When the electronics of FIG. 20 indicate the "end of cigarette" or the indicators of FIG. 9 do so, the lit cigarette is then removed from the cigarette holder 88 by simply pulling on the filter portion and removing the lit cigarette. To ensure a quick disposal of the cigarette before a significant amount of cigarette smoke can escape to the surroundings a pouch 312 is provided which may have a paper exterior 314 and a aluminum foil interior 316. The lit cigarette 318 may be quickly deposited within the open end 320 of the pouch. The flap portion 322 of the pouch is folded over to reduce flow of air to within the pouch and thereby extinguish the lit cigarette 318, as shown in FIG. 26.

Figure 27:
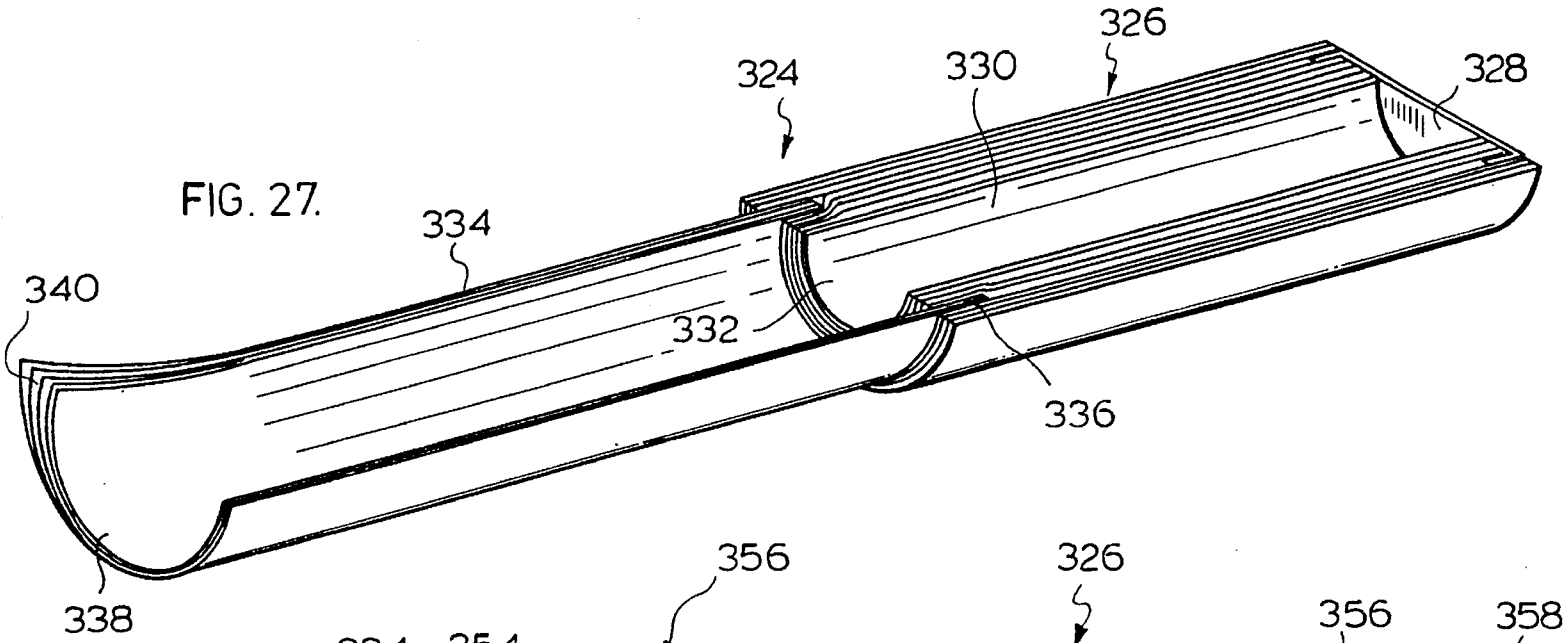
FIG. 27 is a section through the sidestream smoker filter cartridge.

A second alternative embodiment for the sidestream and exhale filters is shown in FIGS. 27 through 30. As shown in FIG. 27 the sidestream filter cartridge 324 has a filter element 326 which is tubular in shape as with the filter element 32 of the sidestream filter of FIG. 5. The tubular filter element 326 has an end cap 328 which seals the distal end of the filter element. An elongate chamber 330 is provided within the filter element which has an inlet region 332. As discussed with respect to FIG. 16, a lit cigarette is placed in the cigarette tube 334. The cigarette tube 334 is connected to the inlet region 332 of the tubular filter at 336. The cigarette tube 334 has an open end 338 to permit insertion of the lit cigarette therein. As shown in FIG. 27, the cigarette tube is made up of multiple layers 340. The multiple layers may be glued together at the end 338 to provide structural rigidity and thereby adapt the end 338 for insertion in an appropriate holder such as the cigarette holder 32 of FIG. 16.

Figure 28:
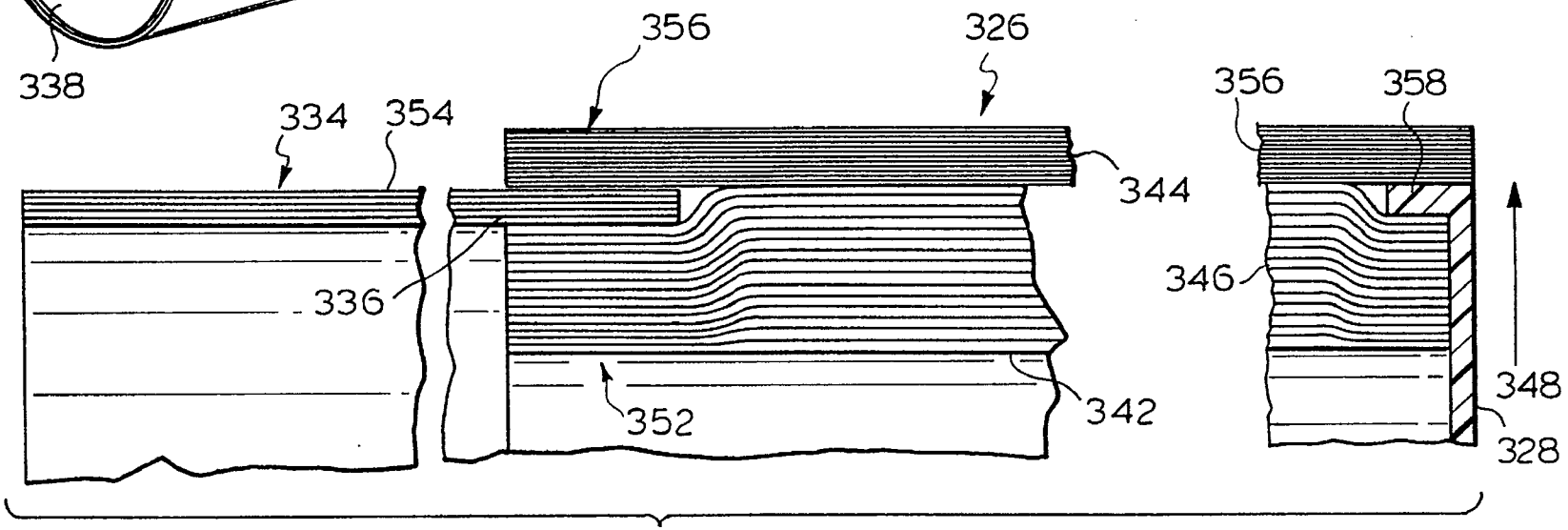
FIG. 28 is an enlarged view of the filter element and cigarette tube of the section of FIG. 27.

As shown in FIG. 28, the tubular filter element 326 comprises an inner filter element 342 and an outer filter element 344. The inner filter element 342 is made up of multiple layers of sheet material 346. The sheet material 118 is layered to form a plurality of layers of filter material in the radial direction, as indicted by arrow 348. The sheet material may be formed of the micro-fibre material described in respect of the high efficiency low pressure drop micro-fibre for the filter 58 of FIG. 5. The micro-fibre material may be either of a suitable micro-fibre forming composition which includes materials of mineral, metal, polymer or any other elemental material capable of being formed into the micro-fibres. A preferred polymer is polypropylene, although it is appreciated that there are several other polymeric materials available which may be spun to form the micro-fibres of the layered product. The process for forming such micro-fibres is described in the aforementioned applicant's issued Canadian Patent 1,057,924. The process by which those fibres are formed into a suitable layer is described in Canadian Patents 1,278,659 and 1,311,889.

The alternative embodiments for the filter element, as described with respect to FIG. 5 and FIG. 27 have somewhat different efficiencies. It has been found that a single layer of the micro-fibre material 58 of FIG. 5 is not as efficient as the multiple layers of micro-fibre material 342, as shown in FIG. 28. By virtue of layering the micro-fibre sheet material, the filtering action is substantially enhanced to remove for a specific radial thickness substantially all of the particulate components thereby only leaving the gaseous components to be removed by the outer filter 344.

The second filter component which surrounds the first filter component is preferably made of activated carbon to adsorb the gaseous components not trapped by the inner filter element 342. It is appreciated that the outer filter element 344 may however be made of other types of material for adsorbing gaseous components such as zeolites sold by Union Carbide under the trade mark Silicalite and as previously used in cigarette filters such as in U.S. Pat. No. 3,327,718. When powdered zeolites, activated carbon or the like are used, the outer filter 344 may be provided by holding the powdered material around the inner filter by use of a porous mesh or the like. Although the mesh is porous to air flow, it retains the free powdered material in the desired shape.

A preferred outer filter material is made of activated carbon fibre which is provided in sheet form. The outer filter element 344 may be made in the form of a single sheet of a desired thickness or alternatively, the sheets 350 may be layered as shown in FIG. 28 to develop the desired thickness for the outer filter element 344. The activated carbon fibres for the sheets 122 may be obtained from various sources of supply, for example, from Futamura Chemical Industries of Nagoya, Japan.

The cigarette tube 334 has its innermost end 336 secured between the outer filter element 344 and the inner filter element 342. The layers 346 are compressed to some extent in region 352 such that they can be positioned within the inside of the inner end 336 of the tube 334. The outer filter element 344 is then positioned on the outside 354 of the cigarette tube 334. Preferably, adhesive is used to adhere end 336 to the inner filter element in region 352 and the outer filter element in region 356.

The cigarette tube 334 is preferably formed of layers of material 340. The layered tube 334 has sufficient structural rigidity such that when the open end 338 is secured to the cigarette holder 88 of FIG. 17 the tube is suspended within the housing of the smoker's accessory.

It is appreciated that the layers for the cigarette tube 334 may be formed of a variety of materials. It is also appreciated that the cigarette tube may be made from a single layer of material which may have a thickness equivalent to the thickness of the multiple layers 340 for the cigarette tube. The preferred material for the cigarette tube 334 is a plurality of overlaid sheets of carbon filled paper. The carbon filled paper may or may not contain a fire retardant to inhibit ignition of the carbon paper by the glowing cigarette. There are several suppliers of carbon paper which may or may not include a fire retardant. The carbon paper typically has a thickness in the range of 0.1 mm to 2 mn and is non-porous to the smoke particles. That is, when the cigarette is burning within the cigarette tube particles cannot escape through the cigarette tube so that all sidestream smoke as emitted by the burning cigarette must pass through the filter element 326.

It is appreciated that such carbon paper may be porous to air unlike the alternate structures such as the glass tube. In accordance with a preferred embodiment of the invention, it has been found that a marginal porosity to air for the cigarette tube is beneficial. That is, the tube material is porous to air under high air pressure, but continues to be non-porous to the cigarette smoke particles and gaseous components.

We have also determined that the cigarette tube ranges in diameter from about 1.5 times the diameter of the cigarette and greater. It has been found that for cigarette tubes having diameters less than about 1.5 times the diameter of the cigarette, the tube material is hence to close to the lit cigarette and charring or overheating of the cigarette occurs which leads to unsatisfactory smoke taste. In view of the tube cross-section being of a variety of shapes it is understood that diameter for the tube is intended to cover the average width dimension of the tube interior. Alternatively, it is understood that the minimum size of tube relative to cigarette diameter may be determined by relative crosssectional surface areas. The cigarette tube therefore has a cross-sectional surface area of at least about 1.5 times _90 which is equal to about 4.7 times the cross-sectional surface area of the cigarette.

The closed end for the filter element 326 is provided by cap 328. The cap 328 has an annular ridge 358 which is positioned between the inner filter element 342 and the outer filter 344. The annular portion 358 may be secured between the inner and outer filter elements by a suitable adhesive. Preferably the outer filter element 344 extends beyond the inner element 342, the thickness of the cap 358 so as to provide a flush end for the sidestream filter cartridge.

Figure 29:
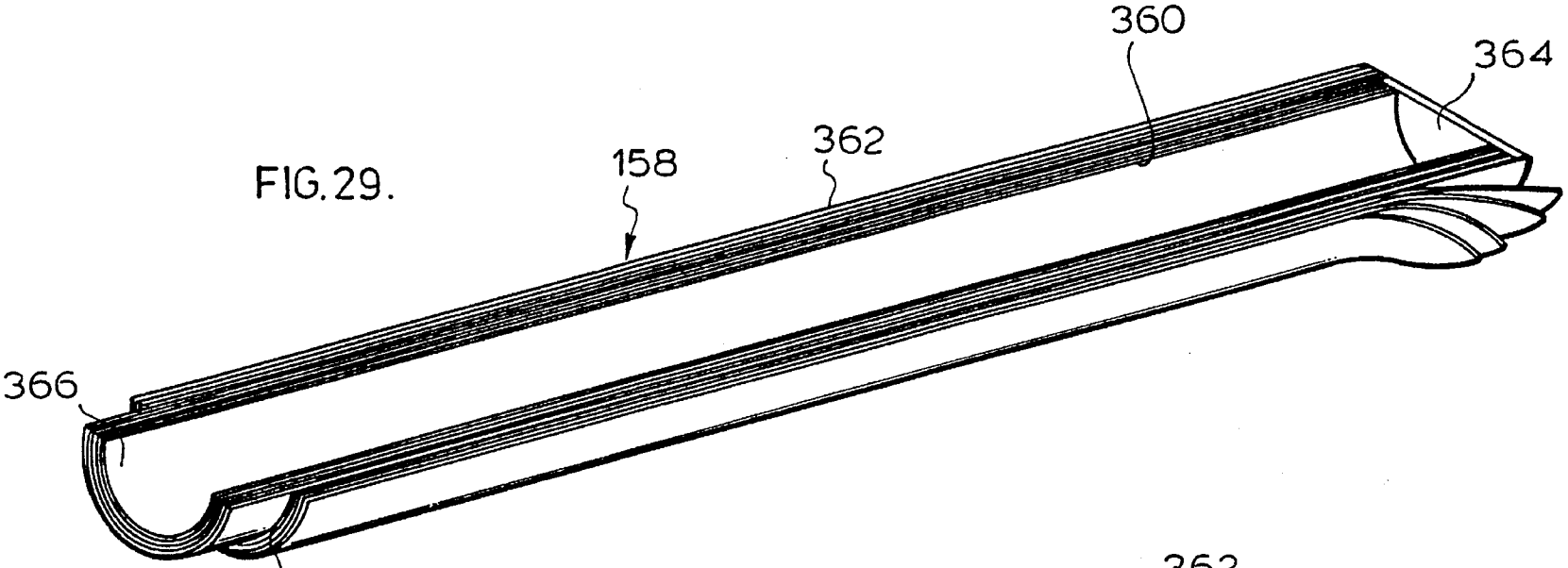
FIG. 29 is a section through the exhale smoke filter cartridge.

FIG. 29 shows an alternative embodiment for the exhale filter 158. The exhale filter has an inner filter element 360 and an outer filter element 362. The exhale filter element 158 has its distal end closed by a cap 364 which may fit between the inner and outer filter elements and be shaped as per the cap 328 of FIG. 28. The cap 364 may be glued in position where the outer filter element 362 extends beyond the inner filter element 360, the thickness of the cap to provide a flush end for the filter element 158. The inner filter element 360 may be formed of the same micro-fibre material used in the inner filter element of FIG. 28. Similarly, the outer filter material 362 may be formed from a sheet of activated carbon fibre used in the outer filter element 344 of FIG. 28. Also, the several alternatives for the inner and outer filter materials, described with respect to FIG. 28 may also be used in the exhale filter of FIG. 29.

Figure 30:
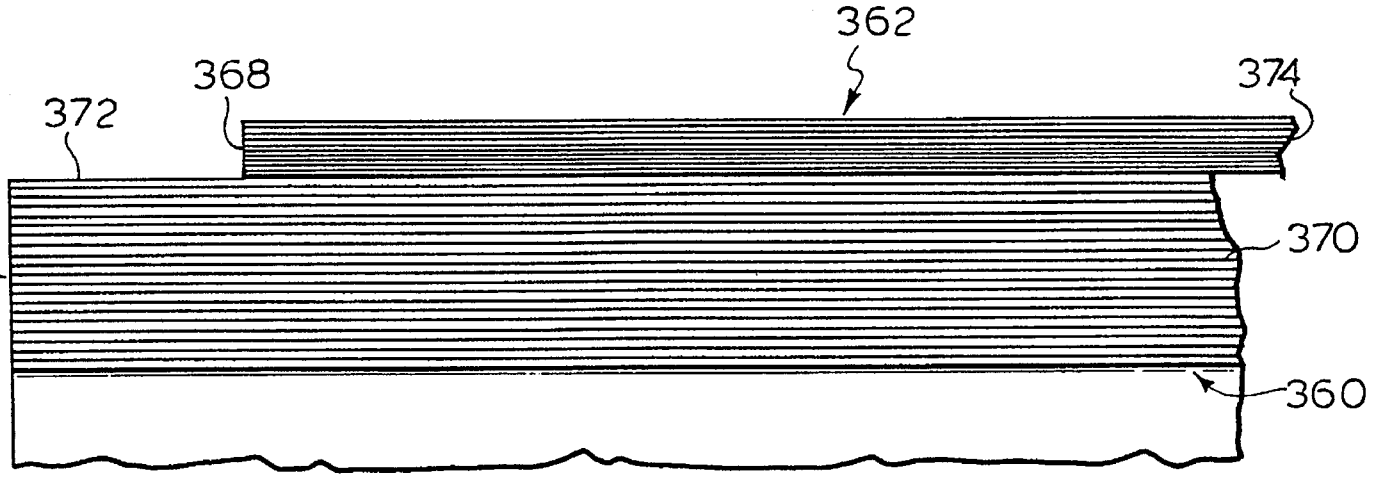
FIG. 30 is an enlarged view of the end portion of the exhale smoke filter cartridge.

The inner tabular filter material 360 has an inlet end 366 which extends beyond the end portion 368 of the outer filter. The inlet end portion 366 is shown in more detail in FIG. 30. The layers 370 of the inner filter 360 may be glued together or may be encased in an outer ring 372 to give that projecting portion 366 sufficient structural integrity such that it may be inserted in a suitable mouth piece such as mouth piece 102 of FIG. 18. As shown in FIG. 30, the inner layers 370 of the micro-fibre material may be considerably thinner than the outer layers 374 of the activated carbon fibre material.

The size and packing weight of the inner filter material may be in the same range as with the inner filter material of FIG. 5, that is, a thickness in the range of about 0.3 mm to about 6 mm and a packing weight in the range of about 5 $g/m^2$ to about 500 $g/m^2$ based on this thickness range. The individual sheets of material may have a thickness in the range of about 0.1 mm to about 3 mm. The preferred ranges for the packing weight is in the range of about 10 to about 200 $g/m^2$ for a sheet thickness of about 0.15 to about 3 mm and the especially preferred range of packing weight in the range of about 10 $g/m^2$ to about 50 $g/m^2$ for the same sheet thickness. The micro-fibre material is especially useful in removing cigarette smoke particles as small as about 0.2 microns in diameter and greater. The preferred size for the micro-fibres in the inner filter is in the range of about 0.5 to about 2.5 microns. The sufficient radial thickness of the charcoal fibre filter is normally in the range of about 1 mm to about 7 mm.

The micro-fibre material is particularly efficient in the removal of particulate components having sizes in the range of about 0.2 microns and greater. It is appreciated that in varying the thickness of the fibre the entire range of smoke particulates can be removed even including those having sizes less than about 0.3 microns. Although the principle of filtration by the micro-fibres is not very well understood, it is thought that the diameter of the particles of the cigarette smoke are in the range of about 0.1 to about 0.6 microns. The small diameter of the micro-fibres used in the filter avoid displacement in the direction of travel of the particles such that they collide directly with the micro-fibres and are then held by the micro-fibres. This is in contrast to the normal thicker fibres typically employed in conventional cellulose acetate filters. Those fibre sizes are normally at range of about 10 to about 25 microns which causes a displacement in the air flow around the fibre so that the particles are diverted from colliding directing with the fibres. This has been demonstrated by testing on several occasions where filter material of the significant thicker diameter fibres is far less effective in removing the smaller particulates than the micro-fibre material having diameter sizes in the range of about 0.1 to about 10 microns and preferably less than about 5 microns. In some applications the preferred fibre size may range from about 0.5 to about 2.5 microns.

Having described preferred embodiments of the invention in detail, it is apparent that the smoker's accessory according to this invention, which optionally may include an exhale filter system, is user friendly while controlling the release of sidestream smoke and or exhale smoke to the surroundings. The user experiences the same sensation in respect of inhale and exhale as experienced in smoking a cigarette in a normal environment. The exhale filter has a sufficiently low pressure drop to permit almost effortless exhale yet attain the desired degree of filtration of the exhale smoke. The user experiences the normal taste and flavour in smoking the cigarette as would be experienced in smoking the cigarette in normal surroundings. Hence, the smoker's accessory is very attractive to the smoker when the smoker is constrained or restricted in respect of where cigarettes may be smoked. The units are particularly useful in confined spaces, such as aircrafts, buses, trains, cars, the workplace, home environments and the like where the either the smoker is required to use the smoker's accessory or voluntary chooses to use the accessories so as to not release noticeable traces of cigarette smoke.

Although preferred embodiments of the invention are described herein in detail, it will be understood by those skilled in the art that variations may be made thereto without departing from the spirit of the invention or the scope of the appended claims.

We claim:

1. A smoker's accessory for filtering sidestream smoke emitted from a burning cigarette, comprising:

an exhaust fan, means for supporting said exhaust fan, said support means having a sidewall with an inlet for said fan, a sidestream smoke filter cartridge having a cigarette tube in which a burning cigarette is placed, said cigarette tube being at least as long as a cigarette to be smoked, said cigarette tube being non-porous to sidestream cigarette smoke particles, a porous low pressure drop tubular filter element at an end of said cigarette tube for removing sidestream smoke, said filter element having an inlet end for sidestream cigarette smoke to enter an inner elongate chamber within said tubular filter, said tubular filter having a closed end opposite said inlet end, means for connecting a first end of said cigarette tube to said inlet end of said filter element whereby sidestream smoke to be filtered flows along said cigarette tube, into said inner chamber, and outwardly through said tubular filter element, a housing for said sidestream smoke filter cartridge, said housing having a front end wall with an opening provided therein, a cigarette holder having a bore extending therethrough to permit insertion of a lit cigarette through said holder, such cigarette being supported in said cigarette tube by said holder, with a tip portion of such a lit cigarette extending outside of said holder to permit a smoker's lips to contact such cigarette tip, means for mounting said cigarette holder in said housing opening, means for securing a second end of said cigarette tube to said cigarette holder whereby a lit cigarette in said holder is positioned in said cigarette tube, fresh air inlet means for providing fresh air inside said cigarette tube adjacent said second end of said cigarette tube, said exhaust fan drawing fresh air from said fresh air inlet along said cigarette tube and over a lit cigarette, sidestream smoke from a lit cigarette being drawn through said filter cartridge, such filtered air stream being drawn through said housing outlet and into said fan inlet for exhaust by said fan.

2. A smoker's accessory of claim 1 wherein said housing is separate from said fan support means, means being provided for connecting said housing to said fan support means sidewall, said housing having an outlet in communication with said fan inlet, and means for sealing said connection of said housing to said fan support means sidewall.

3. A smoker's accessory of claim 2 wherein said housing has an open side which provides said housing outlet in communication with said fan inlet,.

said sidewall of said fan support means and remaining walls of said housing defining a chamber in which said filter cartridge is positioned by said securing means.

4. A smoker's accessory of claim 2 wherein said means for supporting said exhaust fan comprises a body portion having said sidewall with said fan inlet and an opposing sidewall having an outlet for said fan, said fan being mounted in said body portion between said inlet and said outlet, means for controlling "on" and "off" phases for said exhaust fan being provided in said body portion, means for powering said exhaust fan being provided in said body portion, said control means controlling supply of power to said exhaust fan.

5. A smoker's accessory of claim 4 wherein said powering means is a battery or an external source of electrical power for an electric motor of said exhaust fan or said powering means is a spring wind-up device to drive said exhaust fan.

6. A smoker's accessory of claim 4, wherein said connecting means connects said housing to said body portion with said sealing means sealing such connection, said connection means being releasable to permit opening of said sealing means and removal of said housing from said body portion to facilitate removal of said filter cartridge.

7. A smoker's accessory of claim 4 wherein a first temperature sensor is located at said first end of said cigarette robe to detect a freshly lit cigarette inserted in said cigarette robe, said first temperature sensor being connected to said control means, an airflow rate sensor for detecting operation of said fan when in said "on" phase, said airflow rate sensor detecting a minimum air flow rate for fan operation, said airflow rate sensor being connected to said control means, said control means actuating a signal to a user of a malfunction if said airflow rate sensor senses an airflow rate below said minimum and a lit cigarette is placed in said cigarette robe.

8. A smoker's accessory of claim 7 wherein a second temperature sensor is located adjacent said second end of said cigarette robe, said second temperature sensor being connected to said control means, said control means actuating a signal to a user of "end of cigarette" when said second temperature sensor senses a burning cigarette near said second end of said cigarette robe.

9. A smoker's accessory of claim 4 wherein a temperature sensor is located adjacent said second end of said cigarette robe to sense a burning cigarette near said second end, said temperature sensor upon detecting a burning cigarette activating a signal to indicate to a user "end of cigarette".

10. A smoker's accessory of claim 9 wherein said temperature sensor is a heat sensitive strip which changes colour to indicate "end of cigarette".

11. A smoker's accessory of claim 10 wherein said temperature sensor is a bimetallic strip which moves to indicate "end of cigarette".

12. A smoker's accessory of claim 4 wherein a temperature sensor is located at said first end of said cigarette tube to detect a freshly lit cigarette inserted in said cigarette tube, said first temperature sensor being connected to said control means, means for sensing when said fan is in said "off" phase, said "off" phase sensing means being connected to said control means, said control means actuating a signal to a user of a malfunction if said "off" phase sensing means senses said fan in said "off" phase and said temperature sensor senses a lit cigarette.

13. A smoker's accessory of claim 1 wherein said fresh air inlet means is provided in said cigarette holder.

14. A smoker's accessory of claim 13 wherein said fresh air inlet is a plurality of holes provided in said cigarette holder to permit fresh air to be drawn by said fan into said cigarette tube.

15. A smoker's accessory of claim 14 wherein said bore in said cigarette holder is offset in said holder to position a held cigarette in a lower portion of said cigarette tube, said cigarette holder and said housing opening having cooperating means to register said cigarette holder bore with said lower portion of said cigarette tube, said smoker's accessory having a base for resting on a support surface, said lower portion of said cigarette tube being lowermost when said smoker's accessory is resting on its base.

16. A smoker's accessory of claim 13 wherein said securing means comprises a recessed portion in said cigarette holder, said second end of said cigarette tube being fitted in said recessed portion, said cigarette holder having a projection surrounding said recessed portion, said projection having a shape corresponding to said opening, said projection being fitted in said opening to secure thereby said cigarette tube to said housing opening, said fit of said cigarette tube second end in said recessed portion and said fit of said projection in said opening providing a seal between said cigarette tube and said opening whereby fresh air is only drawn in through said inlet means in said cigarette holder, said cigarette holder being removable from said opening with said cigarette tube attached to permit filter cartridge replacement.

17. A smoker's accessory of claim 16 wherein said bore of said cigarette holder is provided in a removable insert for said cigarette holder, a plurality of removable inserts having different sized bores to hold corresponding different sized cigarettes, any one of said inserts being insertable in said holder to support a corresponding sized cigarette.

18. A smoker's accessory of claim 1 wherein said tube is a paper impregnated with activated carbon.

19. A smoker's accessory of claim 18 wherein said paper is thinner than desired thickness for tube wall, several layers of said paper being used to make up said desired tube wall thickness.

20. A smoker's accessory of claim 1 wherein said tubular filter element comprises:

an inner tubular filter consisting of micro-fibres for removing particulate material from sidestream cigarette smoke, said inner filter having said inlet end, said closed end and said inner elongate chamber, said micro-fibres having an average diameter in the range of about 0.5 to about 10 microns and being made from a suitable fibre forming composition, an outer filter shell surrounding said inner filter, said outer filter shell consisting of activated carbon material held by a support matrix which is porous to air flow, said inner tubular filter being of sufficient thickness to remove substantially all particulate components from cigarette smoke passing from said inner elongate chamber through said tubular filter, said micro-fibre filter material having a low pressure drop to permit an air stream to flow through said filter with minimal resistance to such flow, said activated carbon outer filter shell being of sufficient thickness for adsorbing substantially all gaseous components of cigarette smoke from such filtered sidestream cigarette smoke, said inner tubular filter in combination with activated carbon outer filter providing a filtered air stream substantially free of cigarette smoke for discharge into surroundings.

21. A smoker's accessory of claim 20 wherein said inner tubular filter comprises:

several overlaid layers are of a thin sheet of micro-fibres formed from a polymeric material, said sheet having a width which defines a length dimension of said tubular filter, said layers of polymeric material providing a stage-wise removal of particulates from cigarette smoke to enhance thereby filter performance.

22. A smoker's accessory of claim 21 wherein said activated carbon material is in the form of activated carbon particles held by a mesh support, said particles of activated carbon being held in place about said inner tubular filter by said mesh support.

23. A smoker's accessory of claim 21 wherein said activated carbon is in the form of an integral mat of activated carbon fibres.

24. A smoker's accessory of claim 23 wherein said mat of carbon fibres is thinner than said sufficient thickness of said activated carbon filter, said mat is wrapped around said inner tubular filter to form several layers of said sufficient thickness.

25. A smoker's accessory of claim 24 wherein said inner tubular filter having micro-fibres of a diameter of less than about 5 microns removes smoke particles of about 0.2 microns in diameter and greater from cigarette smoke.

26. A smoker's accessory of claim 25 wherein said micro-fibres have a diameter in the range of about 0.5 to about 2.5 microns.

27. A smoker's accessory of claim 24 wherein said sufficient thickness is in the range of about 1 mm to about 7 mm.

28. A smoker's accessory of claim 20 wherein said micro-fibres are of micro-fibre forming polypropylene, said sufficient thickness for said inner filter being in the range of about 0.3 mm to about 6 mm and a packing weight in the range of about 5 $g/m^2$ to about 500 $g/m^2$ for a thickness in the range of about 0.1 mm to about 3 mm.

29. A smoker's accessory of claim 28 wherein said packing weight is in the range of about 10 $g/m^2$ to about 200 $g/m^2$.

30. A smoker's accessory of claim 29 wherein said packing weight is in the range of about 10 g/m$^2$ to about 50 g/m$^2$.

31. A smoker's accessory of claim 1 wherein said exhaust fan is powered by an electric motor and means for varying fan speed to vary thereby flow rate of fresh air into and along said cigarette tube.

32. A smoker's accessory of claim 1 wherein said cigarette tube has a diameter of at least about 1.5 times the diameter of a cigarette inserted therein.

33. A smoker's accessory for filtering sidestream smoke emitted from a burning cigarette and for separately filtering exhale cigarette smoke, said accessory comprising:

an exhaust fan, means for supporting said exhaust fan, said support means having a sidewall with an inlet for said fan, a sidestream smoke filter cartridge having a cigarette tube in which a burning cigarette is placed, said cigarette tube being at least as long as a cigarette to be smoked, said cigarette tube being non-porous to sidestream cigarette smoke, a porous low pressure drop filter element at an end of said cigarette tube for removing sidestream smoke, said filter element being an elongate tubular element and having an inlet end for sidestream cigarette smoke to enter an inner elongate chamber within said tubular filter, said tubular filter having a closed end opposite said inlet end, a first housing for said sidestream smoke filter cartridge, said housing having a front end wall with an opening provided therein, a cigarette holder having a bore into which a lit cigarette may be inserted, such cigarette being supported in said cigarette tube by said holder, means for mounting said cigarette holder in said housing opening, means for securing a second end of said cigarette tube to said cigarette holder whereby a lit cigarette in said holder is positioned in said cigarette tube, fresh air inlet means for providing fresh air inside said cigarette tube adjacent said second end of said cigarette tube, an exhale smoke filter cartridge having an inner tubular member consisting of micro-fibres for removing particulate material from cigarette smoke, said tubular filter having an inlet end for cigarette smoke to enter an inner elongate chamber within said tubular filter, said tubular filter having a closed end opposite said inlet end, said micro-fibres having an average diameter in the range of about 0.5 to about 10 microns, and being made from a suitable micro-fibre forming composition, an outer filter shell surrounding said inner filter, said outer filter shell consisting of activated carbon material held by a support matrix which is porous to air flow, said inner tubular filter being of sufficient thickness to remove substantially all particulate components from cigarette smoke passing from said inner elongate chamber through said tubular filter, said micro-fibre filter material having a low pressure drop to permit an air stream to flow through said filter with minimal resistance to such flow, said activated carbon outer filter shell being of sufficient thickness for adsorbing substantially all gaseous components of cigarette smoke from such filtered exhaled cigarette smoke stream, an exhale mouthpiece in which a first end portion adjacent said inlet end of said exhale filter cartridge is fitted to facilitate a user exhaling into said exhale filter cartridge, a second housing for said exhale filter cartridge, said second housing having an outlet to permit exhale through said exhale filter cartridge, said second housing having a from end wall in which an opening is provided, means for mounting said exhale mouthpiece in said second housing opening to support said exhale filter cartridge in said second housing, said exhaust fan drawing fresh air from said fresh air inlet along said cigarette tube and over a lit cigarette, sidestream smoke from a lit cigarette being drawn through said filter cartridge, such filtered air stream being drawn through said housing outlet and into said fan inlet for exhaust by said fan.

34. A smoker's accessory of claim 33 wherein said first housing is separate from said fan support means, first means being provided for connecting said first housing to said fan support means sidewall, said first housing having an outlet in communication with said fan inlet, and means for sealing said connection of said housing to said fan support means sidewall.

35. A smoker's accessory of claim 34 wherein said first housing has an open side which provides said housing outlet in communication with said fan inlet, said sidewall of said fan support means and remaining walls of said first housing defining a chamber in which said filter cartridge is positioned by said securing means.

36. A smoker's accessory of claim 33 wherein second means for connecting said second housing to said fan support means and/or said first housing is provided, said second connecting means connects said second housing to said fan support means with said front of said second housing in register with said front end of said first housing, said fan support means having a sidewall in which an exhaust outlet for said fan is provided, said second housing having an inlet in communication with said fan exhaust outlet, the filtered air stream from said exhaust fan flowing over said exhale filter cartridge and out through said second housing outlet.

37. A smoker's accessory of claim 36, wherein said second connection means releasably connects said second housing to said fan support means, said housing being removable from said fan support means to permit replacement of said exhale filter cartridge.

38. A smoker's accessory of claim 33, wherein said exhale filter cartridge in cross-section is smaller than said second housing opening, said mounting means for said exhale mouthpiece being removable from said second housing opening to permit withdrawal of said exhale filter cartridge through said second housing opening for replacement of said exhale filter cartridge.

39. A smoker's accessory of claim 33 wherein said end portion of said exhale filter cartridge is an extension of said inner tubular filter beyond said outer filter shell to provide a tubular shaped end portion, said exhale mouthpiece receiving said tubular shaped end portion and means for fitting said tubular shaped end portion in said exhale mouthpiece.

40. A smoker's accessory of claim 33 wherein said inner tubular filter of said exhale smoke filter cartridge comprises:

several overlaid layers are of a thin sheet of micro-fibres formed from a polymeric material, said sheet having a width which defines a length dimension of said tubular filter, said layer of polymeric material providing a stage-wise removal of particulates from cigarette smoke to enhance thereby filter performance.

41. A smoker's accessory of claim 40 wherein said activated carbon material of said exhale filter cartridge is in the form of activated carbon particles held by a mesh support, said particles of activated carbon being held in place surrounding said inner tubular filter.

42. A smoker's accessory of claim 40 wherein said activated carbon is in the form of an integral mat of activated carbon fibres.

43. A smoker's accessory of claim 42 wherein said mat of carbon fibres is thinner than said sufficient thickness of said activated carbon filter, said mat is wrapped onto itself to form several layers of said sufficient thickness.

44. A smoker's accessory of claim 43 wherein said sufficient thickness is in the range of about 1 mm to about 7 mm.

45. A smoker's accessory of claim 33 wherein said micro-fibres are of micro-fibre forming polypropylene, said sufficient thickness for said inner filter being in the range of about 0.3 mm to about 6 mm and a packing weight in the range of about 10 $g/m^2$ to about 500 $g/m^2$ for a material thickness in the range of about 0.1 mm to about 3 mm.

46. A smoker's accessory of claim 45 wherein said packing weight is in the range of about 10 $g/m^2$ to about 200 $g/m^2$.

47. A smoker's accessory of claim 46 wherein said packing weight is in the range of about 10 $g/m^2$ to about 50 $g/m^2$.

48. A smoker's accessory of claim 47 wherein said inner tubular filter having micro-fibres of a diameter of less than about 5 microns removes smoke particles of about 0.2 microns in diameter and greater from cigarette smoke.

49. A smoker's accessory of claim 48 wherein said micro-fibres have a diameter in the range of about 0.5 to about 2.5 microns.

50. A smoker's accessory of claim 33 wherein said exhaust fan is powered by an electric motor and means for varying fan speed to vary thereby flow rate of fresh air into and along said cigarette tube.

51. A smoker's accessory of claim 33 wherein said cigarette tube has a diameter of at least about 1.5 times the diameter of a cigarette inserted therein.

52. In a smoker's accessory for filtering sidestream smoke emitted from a burning cigarette, having:

an exhaust fan, a sidestream smoke filter system having a cigarette tube in which a burning cigarette may be placed, said cigarette tube being at least as long as a cigarette to be smoked, a sidestream smoke filter element, a housing for said sidestream smoke filter system, said housing having a support for said exhaust fan with an inlet for said fan being provided in a wall portion of said housing, the improvement comprising:

said filter element being tubular and having an inlet end for sidestream smoke to enter an inner elongate chamber within said tubular filter, said tubular filter having a closed end opposite said inlet end, means for connecting a first end of said cigarette tube to said inlet end of said filter element, said cigarette tube being non-porous to sidestream cigarette smoke particles whereby sidestream smoke from a burning cigarette in said cigarette tube flows along said cigarette tube, into said inner chamber and outwardly through said tubular filter element, said housing having a from end wall with an opening provided therein, a cigarette holder having a bore extending therethrough to permit insertion of a lit cigarette through said holder, such cigarette being supported in said cigarette tube by said holder, with a tip portion of such a lit cigarette extending outside of said holder to permit a smoker's lips to contact such cigarette tip, means for mounting said cigarette holder in said housing opening and means for securing a second end of said cigarette tube to said cigarette holder, said bore in said cigarette holder being offset in said holder to position a held cigarette in a lower portion of a cigarette tube, said cigarette holder and said housing opening having cooperating means to register said cigarette holder bore with said lower portion of said cigarette tube, and a plurality of holes being provided in said cigarette holder to permit fresh air to be drawn by said fan through said holder and into said cigarette tube end along said tube to pick up cigarette sidestream smoke rising from a burning cigarette in said lower portion of said cigarette tube; said exhaust fan further drawing said picked-up sidestream smoke through said filter element via said elongate chamber and through said inlet for said exhaust fan.

* * * * *